US009818430B2

(12) United States Patent
Jonan et al.

(10) Patent No.: US 9,818,430 B2
(45) Date of Patent: Nov. 14, 2017

(54) ESTIMATING SOUND SOURCE POSITION WITH MICROPHONE ARRAY CONTROL

(71) Applicant: TOA Corporation, Kobe-shi, Hyogo (JP)

(72) Inventors: Tomohiro Jonan, Kobe (JP); Shinya Fukuda, Kyoto (JP); Yuichi Kageyama, Kyoto (JP)

(73) Assignee: TOA CORPORATION, Kobe-shi, Hyogo (JP)

( * ) Notice: Subject to any disclaimer, the term of this patent is extended or adjusted under 35 U.S.C. 154(b) by 27 days.

(21) Appl. No.: 14/897,407

(22) PCT Filed: Jun. 11, 2013

(86) PCT No.: PCT/JP2013/066121
§ 371 (c)(1),
(2) Date: Dec. 10, 2015

(87) PCT Pub. No.: WO2014/199453
PCT Pub. Date: Dec. 18, 2014

(65) Prior Publication Data
US 2016/0148624 A1 May 26, 2016

(51) Int. Cl.
*H04R 3/00* (2006.01)
*G10L 21/10* (2013.01)
(Continued)

(52) U.S. Cl.
CPC ..... *G10L 21/10* (2013.01); *H04R 1/40* (2013.01); *H04R 3/005* (2013.01); *H04R 29/005* (2013.01);
(Continued)

(58) Field of Classification Search
CPC .. H04R 3/005; H04R 29/005; H04R 2430/20; G10L 21/10
(Continued)

(56) References Cited

U.S. PATENT DOCUMENTS

2006/0165242 A1* 7/2006 Miki ..... H04R 3/005 381/59
2006/0274911 A1* 12/2006 Mao ..... A63F 13/06 381/334
(Continued)

FOREIGN PATENT DOCUMENTS

JP 09-021863 A 1/1997
JP 2006-214740 A 8/2006
(Continued)

OTHER PUBLICATIONS

English translation of International Search Report issued in connection with International Application No. PCT/JP2013/066121, dated Aug. 6, 2013, 2 pages.

*Primary Examiner* — Katherine Faley
(74) *Attorney, Agent, or Firm* — Duane Morris LLP

(57) ABSTRACT

Problem to be Solved
To effectively operate a microphone array provided with a sound source position estimating function.
Solution
A microphone control system of the present invention is realized by the use of a tablet-type computer, for example. On the display of the control system, a two-dimensional simulation diagram 302, for example, simulating the space in which the microphone array is disposed. An array mark 304 simulating the exterior shape of the microphone array is displayed on the simulation diagram 302. Further, a sound source mark 316 indicating the position of the sound source estimated by the microphone array is displayed on the simulation diagram 302. Thus, an operator can intuitively find the position of the sound source in the space in which the microphone array is disposed, by referring to the simulation diagram 302, the array mark 304 and the sound source
(Continued)

mark 316 displayed on the simulation diagram. Thus, the usage of the microphone array is improved.

6 Claims, 43 Drawing Sheets

(51) Int. Cl.
*H04R 1/40* (2006.01)
*H04R 29/00* (2006.01)
*H04S 7/00* (2006.01)
*G10L 21/0216* (2013.01)

(52) U.S. Cl.
CPC ..... *H04S 7/40* (2013.01); *G10L 2021/02166* (2013.01); *H04R 2430/20* (2013.01)

(58) Field of Classification Search
USPC ..... 381/92
See application file for complete search history.

(56) References Cited

U.S. PATENT DOCUMENTS

2010/0008516 A1 1/2010 Ichikawa et al.
2011/0286604 A1* 11/2011 Matsuo ..... G10K 11/1784 381/71.1

FOREIGN PATENT DOCUMENTS

JP 2006-261886 A 9/2006
JP 2010-021854 A 1/2010
JP 2013-093807 A 5/2013

* cited by examiner

| | | | | | | |
|---|---|---|---|---|---|---|
| D[1] | D[2] | D[3] | ----- | D[n] | ----- | D[N] |

[ Sound Source Position History Data ]

FIG.26

ESTIMATING SOUND SOURCE POSITION WITH MICROPHONE ARRAY CONTROL

TECHNICAL FIELD

This invention relates to a microphone array control system and, more particularly, to such a control system for controlling a microphone array provided with a plurality of microphone devices and having a sound source position estimating function to estimate the position of a sound source based on audio signals outputted by a plurality of microphone devices.

BACKGROUND ART

Patent Literature 1 discloses an example of microphone arrays of the type described above. According to Patent Literature 1, a microphone array includes a plurality of microphone devices arranged in array at appropriate intervals. A sound source position estimating function for estimating the position of a sound source is realized on the basis of audio signals outputted from the respective microphone devices, or, more specifically, three, in total, microphone devices, which are microphone devices at opposite ends of the array and a centrally disposed microphone device. Predetermined processing, including delay processing, is provided for the audio signals from the respective microphone devices to realize a relatively sharp directivity of the whole microphone array. In addition, a directivity's tracking function is provided to appropriately adjust the amounts of delay to be provided for the respective audio signals whereby the directivity can track the position of the sound source estimated by the sound source position estimating function.

PRIOR ART LITERATURE

Patent Literature

Patent Literature 1: JP2013-93807A

SUMMARY OF INVENTION

Technical Problem

As stated above, the microphone array disclosed in Patent Literature 1 is provided with unique functions, namely, the sound source position estimating function and the directivity's tracking function. However, there has been no means which makes it possible to directly, especially, visually grasp the operating state of the microphone array including such functions. This has hindered effective use of the microphone array having such unique functions.

An object of the present invention, therefore, is to provide a microphone array control system which can make it possible to directly grasp the operating state of a microphone array having a sound source position estimating function, which enables effective use of the microphone array.

Solution to Problem

To achieve the object, a first aspect of the invention provides a control system for controlling a microphone array including a plurality of microphone devices and having a sound source position estimating function for estimating a position of a sound source from audio signals outputted by the microphone devices. The microphone control system includes display means having a display screen and also display control means for displaying, on the display screen of the display means, a simulation diagram simulating a space in which the microphone array is positioned. The control system further includes data acquisition means for acquiring, from the microphone array, predetermined microphone data including sound source position information representing the position of the sound source estimated by the sound source position estimating function of the microphone array. The display control means operates to display, on the simulation diagram, a sound source symbol representative of the sound source based on the sound source position information contained in the microphone data acquired by the data acquiring means.

Thus, according to the first aspect of the invention, a simulation diagram simulating the space in which the microphone array is disposed is displayed on the display screen of the display means. A sound source symbol representing the sound source is displayed on the simulation diagram. Thus, an operator operating the microphone array control system according to the first aspect of the invention can intuitively know the position of the sound source within the space where the microphone array is disposed, by seeing the simulation diagram and the sound source symbol displayed on the simulation diagram. This can improve the usage of the microphone array.

The simulation diagram of the first aspect of the invention may contain an array symbol representing the microphone array. Then, it is desirable for the display control means to display a connection symbol linearly connecting the array symbol and the sound source symbol on the simulation diagram. With this arrangement, the operator can more intuitively grasp the position of the sound source by seeing the connection symbol, and, more specifically, the direction of the sound source viewed from the microphone array and the distance of the sound source from the microphone array.

The microphone data of the first aspect of the invention may include input level information representing the input levels of sounds inputted into the respective microphone devices. In such case, it is desirable for the display control means to change the manner in which the sound source symbol is displayed in accordance with the input level information contained in the microphone data. With this arrangement, the manner in which the sound source symbol representing the sound source changes in accordance with the input levels of the sound emanating from the sound source and entering into the respective microphone devices, or the magnitude of the sound emanating from the sound source. The operator can intuitively grasp the magnitude of the sound emanating from the sound source by seeing the displaying manner in which the sound source symbol is displayed. What is intended by the "displaying manner" referred to herein is a shape, size, color, pattern etc. of the displayed sound source symbol, or the background and the shading of the sound source symbol, for example.

Furthermore, the microphone array may be provided with sound collection characteristic varying function by which the sound collection characteristics of the microphone array including its directivity can be changed so as to become suitable for detecting the sound emanating from the sound source. In this case, sound collection characteristic variable range setting means may be additionally provided for setting a range over which the sound collection characteristic varying function can vary the sound collection characteristics. It is desirable for the display control means to display, on the simulation diagram, a sound collection characteristic variable range symbol indicating the sound collection characteristic variable range set through the sound collection characteristic variable range setting means. With this arrangement, the sound collection characteristics including the directivity of the microphone array are varied to become suitable for detection of the sound emanating from the sound source. At the same time, the sound collection characteristic variable range over which the sound collection characteristics can be varied can be set as desired, or in other words, can be limited. Thus, the sound collection characteristics can be varied only within the sound collection characteristic variable range, but cannot be varied in ranges outside the sound collection characteristic variable range. This feature is useable in case that some noise sources producing undesirable noise are present in the space in which the microphone array is disposed, for example. Specifically, the sound collection characteristic variable range is set in such a manner as to place the noise source and its vicinity outside the sound collection characteristic variable range, whereby noise from the noise source is prevented from being detected by the microphone array so that no influence of the noise can be given to the microphone array. When the sound collection characteristic variable range is set, a sound collection characteristic variable range symbol is displayed on the simulation diagram. By seeing this sound collection characteristic variable range symbol, the operator can intuitively grasp the sound collection characteristic variable range. This is highly useful for the operator in setting the sound collection characteristic variable range.

When the sound source approaches the microphone array, the input levels of the sound emanating from the sound source and entering the microphone array, or the respective ones of the microphone devices increase. If no measure to deal with increase of the input levels is taken, there is a possibility that the increase of the input levels will cause the output level to increase, which may induce various inconveniences. Accordingly, the microphone array may be additionally provided with an audio signal restricting function for restricting the audio signals from the respective microphone devices when the position of the sound source estimated by the sound source position estimating function approaches the microphone array. For that purpose, restriction execution distance setting means is provided for setting a distance border. When the sound source approaches the microphone array across the distance border, the restriction of the audio signals is executed by the audio signal restricting function. Then, the display control means desirably display, on the simulation diagram, a restriction execution distance symbol representing the distance set by the restriction execution distance setting means. With this arrangement, the operator can intuitively grasp the restriction execution distance border which is the border to determine whether to execute the restriction of the audio signals by the use of the audio signal restricting function. By seeing the sound source symbol, too, or seeing whether the sound source symbol is on the microphone array side of the restriction execution distance symbol, the operator can intuitively know whether the audio signal restriction is being executed by the audio signal restricting function.

Furthermore, according to the first aspect of the invention, there may additionally be provided history storage means for storing the history of the sound source position information. In this case, the display control means desirably display, on the simulation diagram, a tracing symbol representing the trace of the sound source based on the history of the sound source position information stored in the history storage means. With this arrangement, the operator can intuitively grasp the moving trace and/or moving range of the sound source by seeing the trace symbol.

A second aspect of the invention relates to a computer program corresponding to the first aspect of the invention. According to the second aspect of the invention, a computer program to be executed by a computer is provided, which computer is connected to a microphone array with a plurality of microphone devices and having a sound source position estimating function for estimating the position of a sound source based on audio signals outputted by the plurality of microphone devices. The computer includes display means having a display screen. The computer is caused to execute a display controlling step for simulating, on the display screen of the display means, a simulation diagram of a space where the microphone array is disposed. The computer is further caused to execute a data acquiring step for acquiring, from the microphone array, predetermined microphone data including sound source position information representing the position of the sound source as estimated by the sound source position estimating function of the microphone array. The display controlling step causes a sound source symbol representative of the sound source to be displayed on the simulation diagram, based on the sound source position information contained in the microphone data as acquired in the data acquiring step.

BRIEF DESCRIPTION OF DRAWINGS

FIG. 26 is an illustration showing a conceptual arrangement of sound source position history data to be used by the control apparatus to realize a tracing display function of the present embodiment.

DESCRIPTION OF EMBODIMENT

By way of example, a loudspeaker system 10 for use in lecturing is described to explain one embodiment of the present invention.

Figure 1:
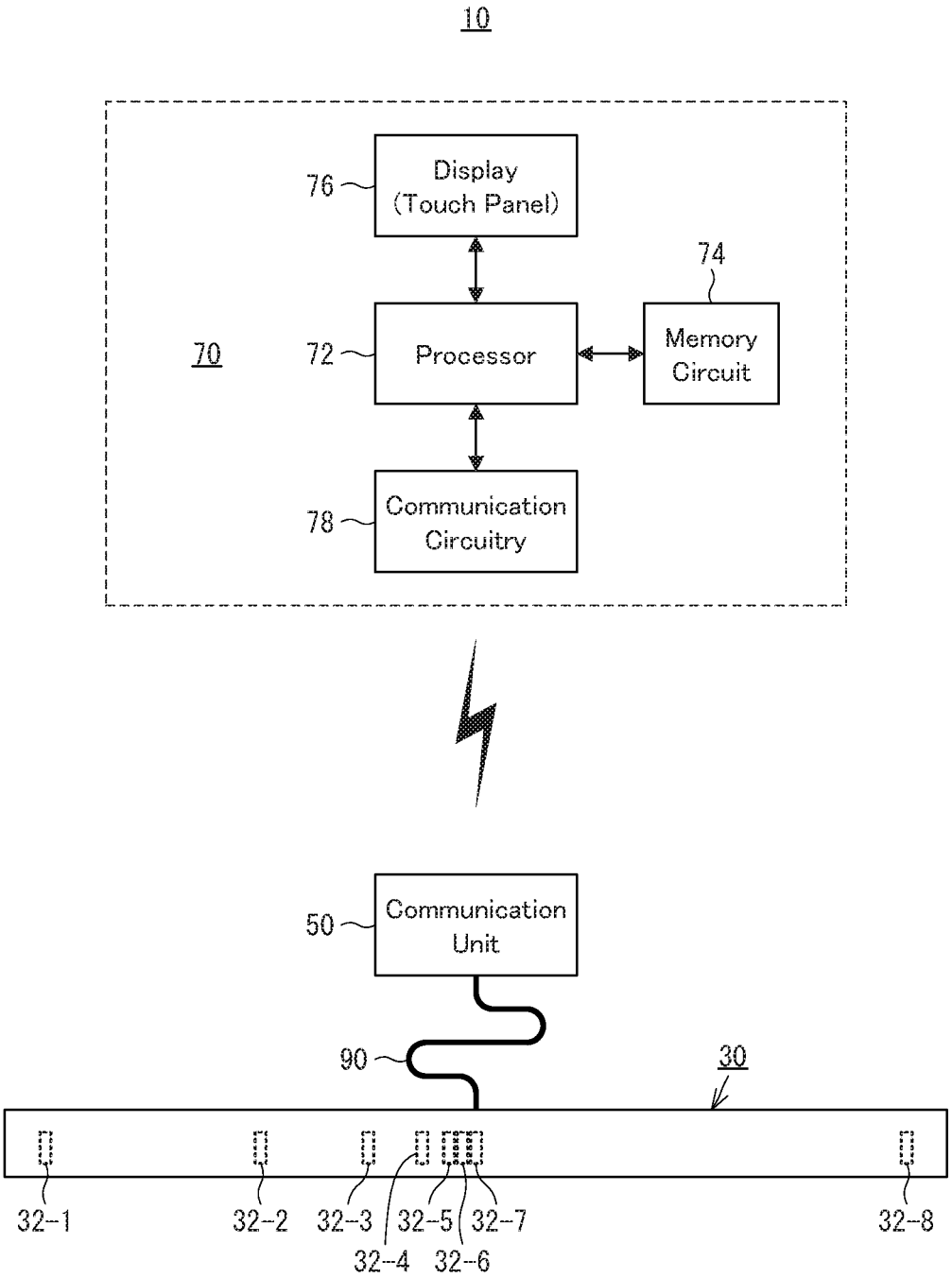
FIG. 1 is a block diagram schematically showing the arrangement according to one embodiment of the invention.

As shown in FIG. 1, the loudspeaker system 10 for use in lecturing according to one embodiment of the present invention includes a microphone array 30 disposed on a speech stand on a platform, for example, a communication unit 50 to be connected to the microphone array 30, and a control system 70 for controlling the microphone array 30 through the communication unit 50.

The microphone array 30 is basically the same as the one disclosed in Patent Literature 1. The microphone array 30 includes plural, for example, eight, microphone devices 32-1 through 32-8. The microphone devices 32-1 through 32-8 are unidirectional and made according to the same specifications, and are arranged in row or array at appropriate intervals. Using audio signals outputted by the microphone devices 32-1 through 32-8, or, more specifically, based on the audio signals from the three, opposite end and centrally disposed microphone devices 32-1, 32-8 and 32-7, the position of a sound source (a lecturer) (not shown) is estimated. In other words, the microphone array 30 is provided with a sound source position estimating function. More specifically, using time differences with which the audio signals from the sound source arrive at these three microphone devices, the angle and the distance of the sound source relative to the microphone array 30 are calculated. Predetermined processing, including delaying processing, is provided for audio signals from the respective microphone devices 32-1 through 32-8, whereby a relatively sharp directivity of the whole microphone array is realized. Further, a directivity's tracking function is provided in which the amounts of delay to be imparted to the respective audio signals are appropriately adjusted by the delay processing so that the orientation of the directivity is adjusted to follow the position of the sound source estimated by the sound source position estimating function. Based on the angle calculated by the sound source position estimating function, individually determined amounts of delay are imparted to the input signals from the respective microphone devices 32-1 through 32-8 so as to orient the directivity to the sound source position as estimated by the sound source position estimating function. The sound source position estimating function and the directivity's tracking function are described in detail in Patent Literature 1 and, therefore, no further detailed description of them are given herein.

The microphone array 30 is also provided with a level correcting function for lowering the level of the audio signals from the respective microphone devices 32-1 through 32-8 when the position of the sound source as estimated by the sound source position estimating function approaches the microphone array 30. More specifically, when the position of the sound source estimated by the sound source position estimating function approaches a location at a distance shorter than the later-mentioned level correction executing distance from the microphone array 30, gains corresponding to the degree of approach are applied to the audio signals from the respective microphone devices 32-1 through 32-8. For example, as the sound source position approaches the microphone array 30 by one meter (1 m), a gain of −6 dB is applied. By this arrangement, the levels of the audio signals from the microphone devices 32-1 through 32-8 are lowered.

Although not shown, the microphone array 30 has a processor including a CPU (Central Processing Unit) and a DSP (Digital Signal Processor), and this processor realizes the sound source position estimating function, the directivity's tracking function and the level correcting function. The microphone array 30 appropriately combines the audio signals from the microphone devices 32-1 through 32-8 and outputs the resultant output signal. The output signal is inputted through an external amplifying device to an external loudspeaker. Further, the microphone array 30 is provided with a muting function by which the outputting of the resultant output signal is disabled or enabled in response to a later-mentioned muting setting command.

The communication unit 50 realizes bidirectional communications by the use of, for example, a wireless LAN (Local Area Network), between the microphone array 30 and the control system, and is connected to the microphone array 30 through a dedicated cable 90, which makes it possible that the control system 70 and the microphone array 30 communicate with each other through the communication unit 50. The communication unit 50 may be disposed near the microphone array 30, but it may be built in the microphone array 30.

The control system may be a tablet-type computer, for example, and, more specifically, a computer in which an application program for controlling the microphone array 30, or microphone array control program, is installed. The control system 70 includes a processor 72 including a CPU etc. To the processor 72, a memory circuit 74 in which the microphone array control program is installed is connected. A touch panel display 76 is connected to the processor 72, which functions as display means for displaying various information including later-mentioned control pictures and also as input means receiving command operations from an operator corresponding to the displayed various information. In addition, the processor 72 is connected to communication circuitry 78 to achieve bidirectional communications with the microphone array 30 through the communication unit 50. When the microphone array control program is started, the memory circuit 74 retains therein a conversion coefficient for use in converting an actual length dimension in the real space, in which the microphone array 30 is present, to and from a length dimension on a control picture (an operating state display section 300, in particular, described later) displayed on the display panel 76. The positions etc. of an array mark 304 and a sound source mark described later are displayed on the control picture as a result of conversion, by the conversion coefficient, of the information in the real space transmitted from the microphone array 30.

When the microphone array control program installed in the control system 70 is activated, a microphone array selecting picture (not shown) is displayed on the display 76 of the control system 70. On this microphone array selecting picture, it is possible to select and add other microphone array 30, for example, by using GUI (Graphical User Interface) operation. Thus, plural microphone arrays 30 can be controlled through a single control system 70. Since this feature, however, does not have a direct connection to the subject invention, no further description in detail is given herein. It is also possible to switch the later-described user level on the microphone array selecting picture, but how to switch the user level is not described here. For example, when a microphone array 30 with a number "01" attached to it is selected on the microphone array selecting picture, a control picture like the one shown in FIG. 2 is displayed on the display 76 of the control system 70.

Figure 2:
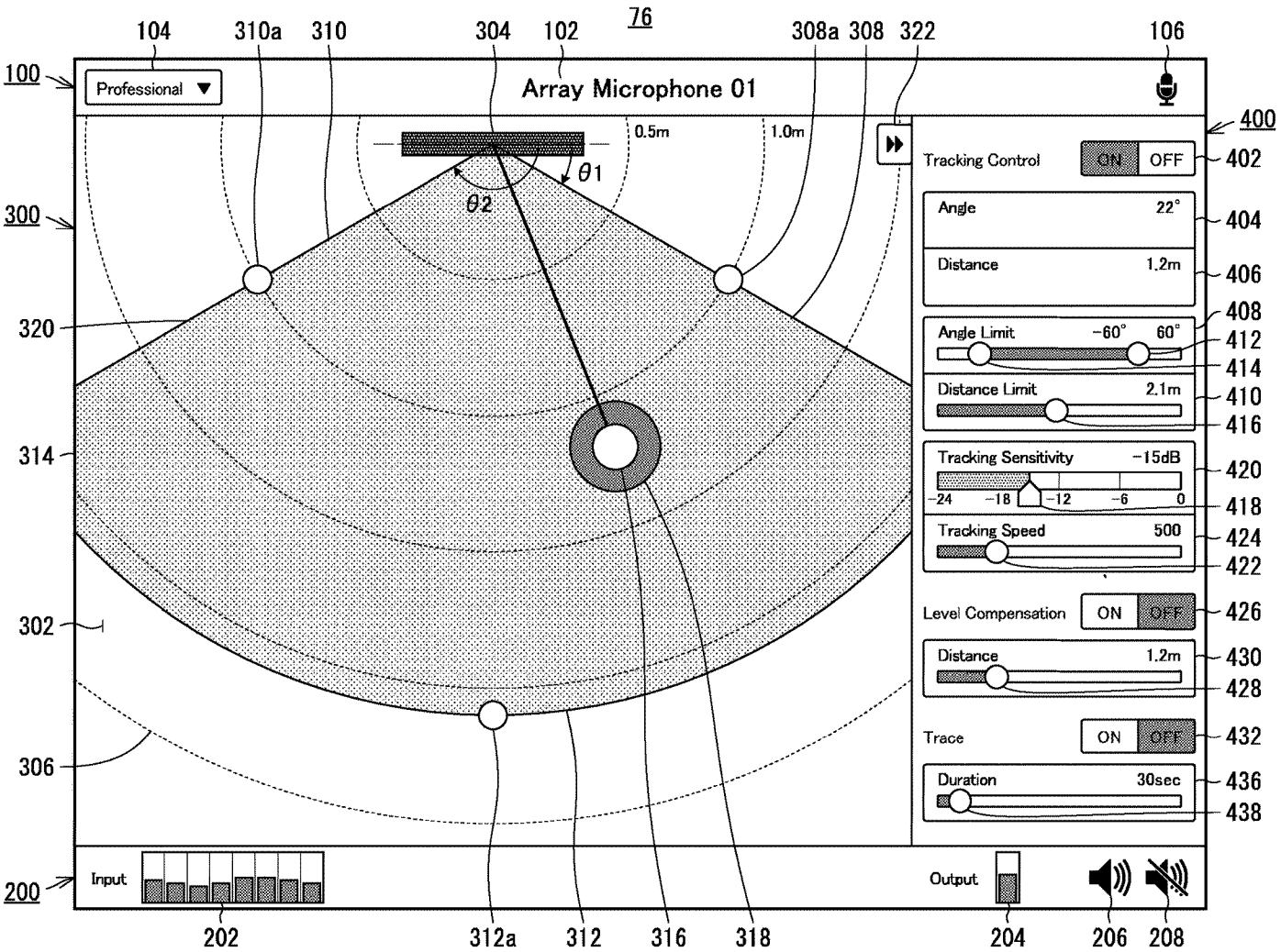
FIG. 2 is an illustration of an example of a control picture displayed on a display according to the present embodiment.

The control picture shown in FIG. 2 includes a header section 100, a footer section 200, an operating state display section 300, and a main operation section 400. The header section 100 is disposed in the top portion of the control picture to extend long sideways along the top edge of the control picture. In substantially the center of the header section 100, there is displayed a character row 102, "Array Microphone 01", indicating that the microphone array 30 with the number "01" attached thereto is the microphone array to be controlled. In addition, in the left-end portion of the header section 100, a user level switching button 104 is displayed for changing the above-mentioned user level. Further, in the right-end portion of the header section 100, a "mike" mark 106 is displayed. The mike mark 106 in FIG. 2 is shaped like a ribbon microphone, for example. This mike mark 106 is used to terminate the microphone array control program.

The footer section 200 is disposed in the lower portion of the control picture and extends long sideways along the bottom edge of the control picture. In the left-end portion of the footer section 200, an input level meter 202 is displayed, which indicates input levels of a voice entering the respective microphone devices 32-1 through 32-8. Near the right-end portion of the footer section 200, a level meter 204 indicating the level of the output signal of the microphone array 30 is displayed. A loudspeaker mark 206 in the shape of a loudspeaker is displayed on the right side of the level meter 204. The loudspeaker mark 206 functions as a volume control button for controlling the output signal level. A backslashed loudspeaker mark 208 is displayed on the right side of the volume control button 206. The backslashed loudspeaker button 208 functions as a muting switching button for turning on and off the muting function.

The operating state display section 300 occupies a larger part on the left side of the portion of the control picture sandwiched between the header section 100 and the footer section 200. In this operating state display section 300, a simulation diagram, e.g. two-dimensional simulation diagram 302, simulating the space in which the microphone array 30 is disposed, is displayed. Also, concentric scale lines 306 concentric about the reference position, e.g. the center, of the array mark 304 are displayed. The scale lines 306 indicate the distance from the base point, which is the reference position of the microphone array 30. In FIG. 2, the scale lines 306 are displayed at intervals corresponding to a distance of 0.5 m, but different intervals may be used.

The later-described two straight angle boundary lines 308 and 310 are also displayed to extend along radii of the concentric scale lines 306 from the reference position of the array mark 304. A later-described arcuate distance boundary line 312 extending along a circle having its center at the reference position of the array mark 304 and contacting the two angle boundary lines 308 and 310 is also displayed. A generally fan-shaped area 314 defined by the boundary lines 308, 310 and 312 corresponds to the later-described directivity changeable range. At appropriate locations on respective ones of the boundary lines 308, 310 and 312, circular handling markers 308*a*, 310*b* and 312*c* are present. The handling markers 308*a*, 310*b* and 312*c* are for handling, or moving the respective boundary lines 308, 310 and 312 to thereby change the directivity changeable range.

In addition, a sound source mark 316, which may be circular, representative of the sound source is displayed on the simulation diagram 302. A volume mark 318, which is a circle (or ring) concentric with the sound source mark 316, surrounds the sound source mark 316. A straight line connecting mark 320 is displayed to connect the center of the sound source mark 316 with the reference position of the array mark 304. In a portion, an upper right portion, for example, of the operating state display section 300, a generally rectangular main operation section display switching button 322 bordering along its one side with the main operation section 400 is displayed.

The main operation section 400 is on the right side of the operating state display section 300. A control mode switching button 402 is displayed in an upper portion of the main operation section 400 for turning on and off the directivity's tracking function. Below the control mode switching button 402, there are displayed a sound source direction handling and display section 404 and a sound source distance handling and display section 406 in the named order from up to down to show the current position of the sound source. On the sound source direction handling and display section 404, the direction of the sound source position viewed from the reference position of the microphone array 30 is displayed in degree of angle, or, more specifically, the degree of angle of deviation of the direction of the sound source from the reference direction which is the direction viewed from the reference position of the microphone array 30 to its front (i.e. the direction viewed from the reference position right downward in FIG. 2). When the sound source position viewed from the reference position of the microphone array 30 is on the left side of the reference direction (i.e. the right side in FIG. 2), the angle of deviation is expressed as a plus value, and when the sound source position viewed from the reference position of the microphone array 30 is on the right side of the reference direction (i.e. the left side in FIG. 2), the angle of deviation is expressed as a minus value. On the sound source distance handling and display section 46, the distance from the reference position of the microphone array 30 to the sound source position is displayed. In this connection, it is seen that, in the example shown in FIG. 2, the direction (angle) of the sound source position is plus 22 degrees with respect to the reference direction, and the distance of the sound source position from the reference position of the microphone array 30 is 1.2 m.

Below the sound source distance handing and display section 406, there are displayed an angle boundary handling and display section 408 and a distance boundary handling and display section 410 in the named order with the angle boundary handling and display section 408 being nearer to the sound source handling and display section 406. More specifically, two sliders 412 and 414 for handling the angle boundary lines 308 and 310 are displayed. Also, the angles (i.e. the angles of deviation) of the directions in the real space corresponding to the two angle boundary lines 308 and 310 with respect to the above-described reference direction are displayed on the angle boundary handling and display section 408. The slider 412 for use in handling or moving the plus-side angle boundary line 308 is arranged to operate in association with the above-stated handling marker 308*a* attached to the plus-side angle boundary line 308. Similarly, the slider 414 for use in handling the minus-side angle boundary line 310 is arranged to operate in association with the handling marker 310*a* attached to the minus-side angle boundary line 310. A slider 416 is displayed in the distance boundary handling and display section 410 for use in handling or moving the distance boundary line 312. In the distance boundary handling and display section 410, the distance in the real space corresponding to the distance from the reference position on the array mark 304 to the distance boundary line 312 is displayed. The slider 416 for use in handling or moving the distance boundary line 312 is arranged to operate in association with the handling marker 312*a* attached to the distance boundary line 312. In this connection, it is noted that, in the example shown in FIG. 2, the direction in the real space corresponding to the plus-side angle boundary line 308 is set to be 60 degrees, the direction in the real space corresponding to the minus-side angle boundary line 310 is set to be −60 degrees, and the distance in the real space corresponding to the distance from the reference position on the array mark 304 to the distance boundary line 312 is set to be 2.1 m.

Beneath the distance boundary handling and display section 410, there are displayed an estimation sensitivity handling and display section 420 having a slider 418 for use in controlling a sensitivity of sound source position estimation performed by the sound source position estimating function, and an estimation speed handling and display section 424 having a slider 422 for use in controlling a speed of the sound source position estimation performed by the sound source position estimating function, with the estimation sensitivity handling and display section 420 placed near to the distance boundary handling and display section 410. In the estimation sensitivity handling and display section 420, the sound source estimation sensitivity controlled through the handling of the slider 418 is displayed, and, in the estimation speed handling and display section 424, the sound position estimation speed adjusted through the handling of the slider 422 is displayed. In this connection, it is noted that, in the example shown in FIG. 2, the sound source position estimation sensitivity is −15 dB and the sound source position estimation speed is 500. The sound source position estimation sensitivity and the sound source position estimating speed are described in detail later.

Below the estimation speed handling and display section 424, there is displayed a level correction switching button 426 for ON/OFF switching the aforementioned level correcting function. Below this level correction switching button 426, there is displayed a level correction executing distance handling and display section 430 with a slider 428 for use in setting the later-mentioned level correction executing distance. In this level correction executing distance handling and display section 430, the level correction executing distance set through the handling of the slider 428 is displayed. In the example shown in FIG. 2, the set level correction executing distance from the reference position on the microphone array 30 is 1.2 m.

Below the level correction executing distance handling and display section 430, there is displayed a tracing display switching button 432 for use in ON/OFF switching the tracing display function described later. A tracing display duration handling and display section 436 with a slider 434 is displayed below the tracing display switching button 432. The slider 434 is used to set the duration for maintaining the tracing display performed by the tracing display function. In this tracing display duration handling and display section 436, the tracing display duration set through the slider 434 is displayed. In the example shown in FIG. 2, the tracing display duration is set at 30 seconds.

The control picture first displayed shown in FIG. 2, or the control picture first displayed when the microphone array control program is activated, is the control picture being displayed in the previous operation immediately before the termination of the microphone array control program. It should be noted that, the predetermined initial control picture is displayed when the microphone array control program is activated for the first time or is reset.

While the above-described control picture is being displayed on the display 76 of the control system 70, the control system 70 (or, more specifically, the processor 72) requests the microphone array 30 for microphone data at predetermined time intervals Ta, for example, Ta=30 msec. Each time the microphone array 30 receives this request from the control system 70, the microphone array 30 transmits the latest microphone data to the control system. At the same time, the microphone array 30 repeatedly performs the sound source position estimating operation by the sound source position estimating function at time intervals shorter than the microphone data request periods (transmission period) Ta. The microphone data referred to herein contains, for example, sound source position information (direction and distance) representing the sound source position as estimated by the sound source position estimating function, input level information representative of the levels of the audio signals from the respective microphone devices 32-1 through 32-8. On receiving the microphone data transmitted from the microphone array 30, the control system 70 renews the display contents on the control picture.

More specifically, the display of the sound source mark 316 in the operating state display section 300 is renewed based on the sound source position information contained in the microphone data. Thus, an operator operating the control system 70 can instantly grasp the position of the sound source by seeing the sound source mark 316. Similarly, the display of the connecting mark 320 is renewed. Accordingly, when the sound source moves, the sound source mark 316 behaves like a yoyo together with the connecting mark 320. This makes it easier to grasp the sound source position, in particular, the direction and distance of the sound source from the microphone array. In addition, the values of the direction and distance of the sound source position displayed respectively in the sound source direction handling and display section 404 and the sound source distant handling and display section 406 are renewed.

Figure 3:
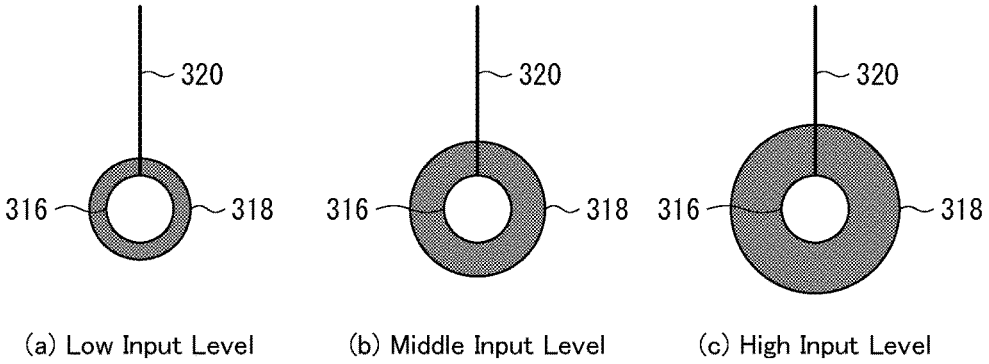
FIG. 3 is an illustration illustrating how a sound source mark is displayed.

The display of the input level meter 202 in the footer section 200 is also renewed based on the input level information contained in the microphone data. The input levels of the microphone devices 32-1 through 32-8 according to the input level information are averaged, and the display of the volume mark 318 in the operating state display section 300 is renewed in accordance with the average input level, or, in other words, the size (i.e. diameter) of the volume mark 318 is changed as shown in FIG. 3. By seeing the volume mark 318 or the size of the mark 318, the operator can instantly know the volume of the sound source. The size of the volume mark 318 is at least as large as the sound source mark 316.

Based on the output level information contained in the microphone data, the display of the output level meter 204 in the footer section 200 is renewed. The operator sees the output level meter 204 and can instantly grasp the level of the output signal.

Let it be assumed that, at this instant, the directivity's tracking function has been turned on as a result of a pushing down (or tapping) operation of the control mode switching button 402 in the main operation section 400. In this case, the microphone array 30 changes its own directivity to conform with the position of the sound source estimated by the sound source position estimating function, or, in other words, makes the directivity track the sound source position. Thus, the microphone array 30 is placed in an automatic mode, and the sound emanating from the sound source is efficiently detected by the microphone array 30, whereby influence of sounds and noise, in particular, emanating from sources other than the sound source is reduced.

Figure 4:
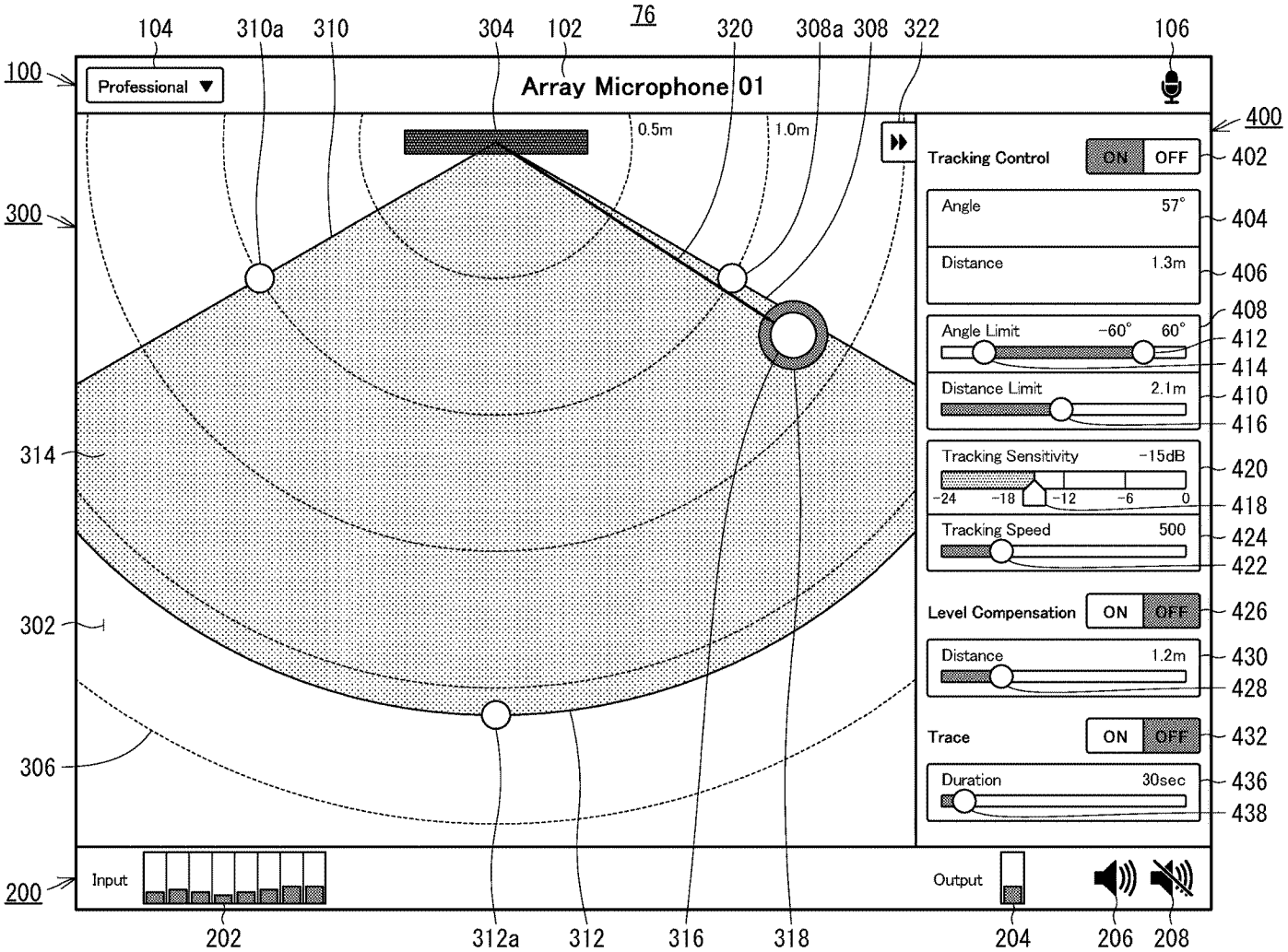
FIG. 4 is an illustration illustrating the control picture in a situation different from the one shown in FIG. 2.
Figure 5:
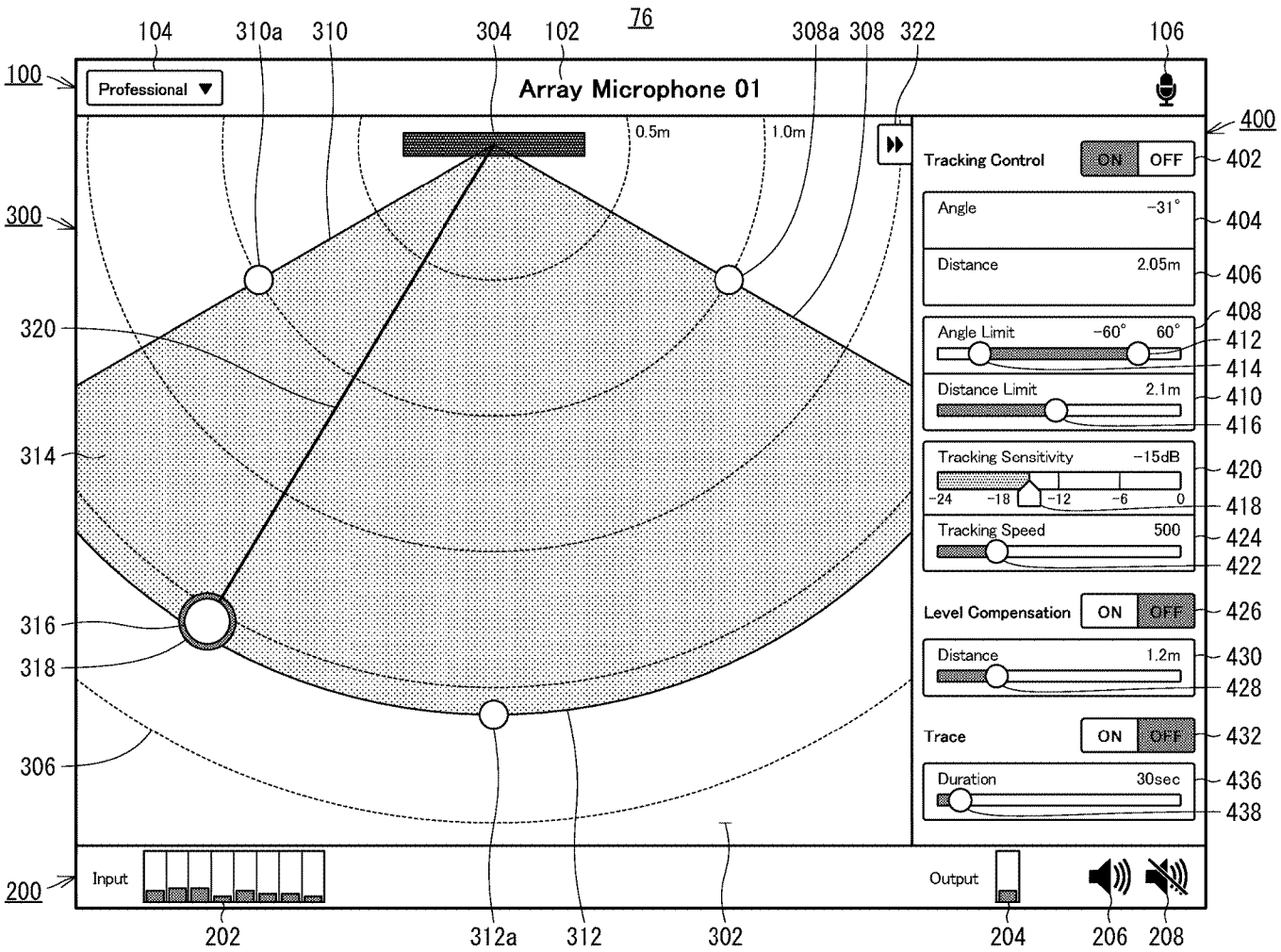
FIG. 5 is an illustration illustrating the control picture in a situation different from the one shown in FIG. 4.

This tracking action (according to the directivity's tracking function) in the automatic mode is performed only when the sound source is in the directivity changeable range set in accordance with the area 314 corresponding to the directivity changeable range, and otherwise is not performed. For example, when the sound source goes out of the directivity changeable range, the sound source is treated as if it were at the position immediately before it goes out the directivity changeable range. FIG. 4 shows a state where the sound source goes out across the plus-side angle boundary of the directivity changeable range, and FIG. 5 shows a state where the sound source goes out across the distance boundary of the directivity changeable range. It should be noted that even if the sound source goes out of the directivity changeable range as in the cases shown in FIGS. 4 and 5, or in other words, even when the tracking operation is not being carried out in the automatic mode, the sound source estimating operation is always performed.

Figure 6:
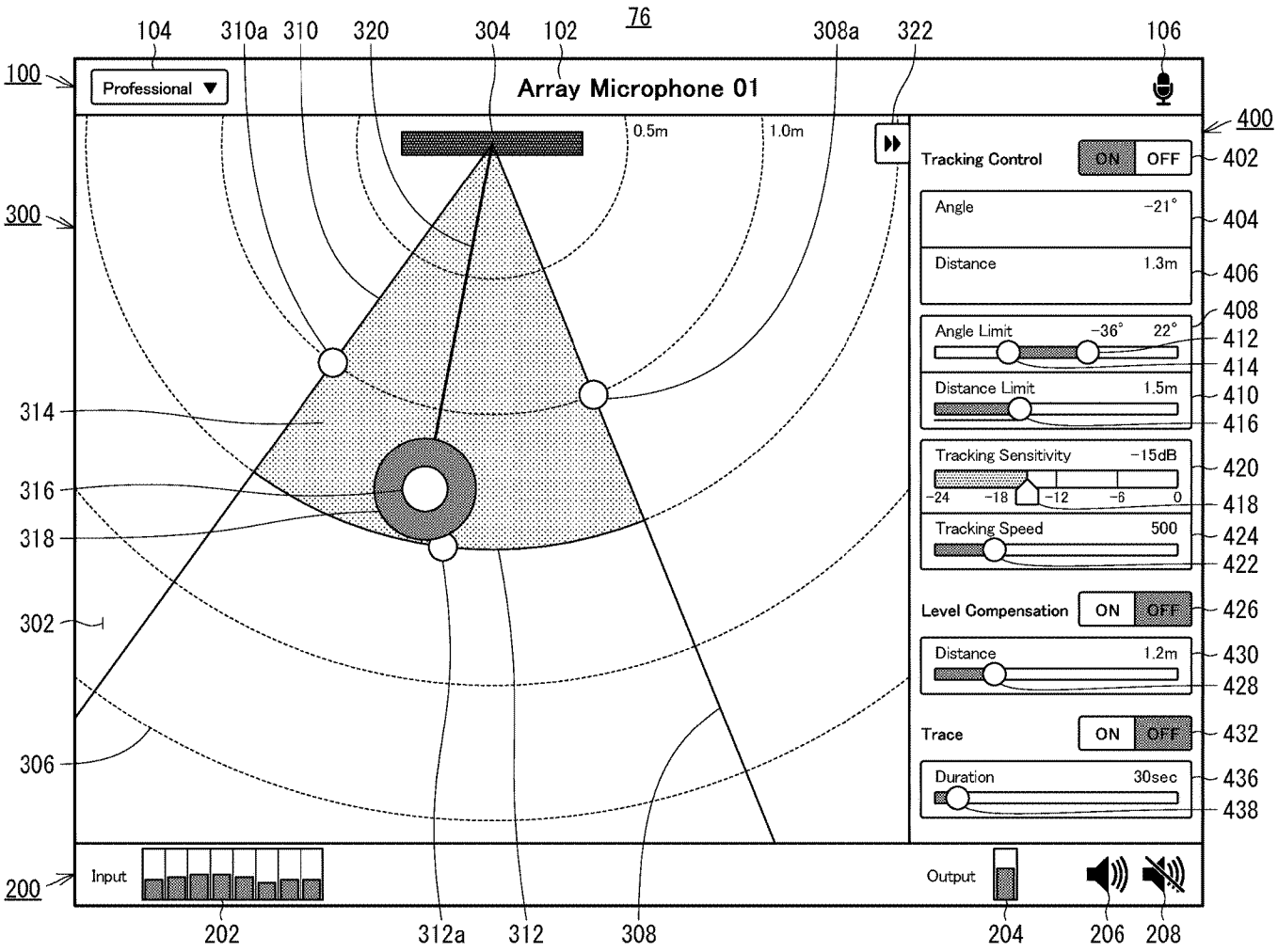
FIG. 6 is an illustration illustrating the control picture in a situation different from the one shown in FIG. 5.

The directivity changeable range can be changed as desired on the control picture. For example, by moving (dragging) the handling markers 308*a* and 310*a* associated with the respective angle boundary lines 308 and 310 which define the directivity changeable range corresponding area 314 within the operating state display section 300, the positions (angles) of the angle boundary lines 308*a* and 310*a* are changed, which results in change of the angle boundaries of the directivity changeable range in the real space. As shown in FIG. 2, the angle boundaries are defined by a plus-side directivity change limit angle θ1 and a minus-side directivity change limit angle θ2 relative to the direction along the length of the microphone array 30 (or the length of the array mark 304 in the control picture). Further, by moving the handling marker 312*a* associated with the distance boundary line 312 defining the directivity changeable range corresponding area 314, the position (or radius) of the distance boundary line 312 is changed, which results in change the distance boundary of the directivity changeable range. Also, by moving the sliders 412 and 414 in the angle boundary handling and display section 408 within the main operation section 400, the angle boundary lines 308 and 310 are changed, which results in change of the angle boundaries of the directivity changeable range. In addition, by moving the slider 416 of the distance boundary handling and display section 410 in the main operation section 400, the distance boundary line 312 is changed, which results in change of the distance boundary of the directivity changeable range. FIG. 6 shows an example of the operating state wherein the respective boundary lines have been changed and, as a result, the directivity changeable range has been changed. Although not shown, the simulation diagram 302 containing the respective handling markers 308*a*, 310*a* and 312*a* within the operating state display section 300 can be zoomed in or out, or can be shifted upward, downward, leftward or rightward. This arrangement enlarges the handling range of the respective handling markers 308*a*, 310*a* and 312*a* within the operating state display section 300. Appropriate color or colors and/or patterns are provided for the directivity changeable range corresponding area 314. In other words, the directivity changeable range corresponding area 314 is displayed in a different manner from the remaining portions of the operating state display section 300.

By properly setting the directivity changeable range, influences of undesired noise, for example, can be removed. Specifically, even when there is a noise source generating undesired noises in the space where the microphone array 30 is disposed, the directivity changeable range is so determined as to place the noise source and its vicinity outside the directivity changeable range. Then, even if sound source estimation is performed based on the noises from the noise source inputted to the microphone array 30, not based on the sound from the desired sound source, it does not occur that the directivity is oriented toward the erroneously estimated sound source position. Thus, erroneous operation of the directivity's tracking function can be prevented.

When the slider 418 of the estimation sensitivity handling and display section 420 within the main operation section 400 is handled or moved, the sound position estimation sensitivity by the sound position estimating function changes. For example, when the slider 420 is moved leftward, the estimation sensitivity increases. Then, it is possible to estimate the position of the sound source even when the volume of the sound is relatively low, although the sound source position estimating function becomes liable to be influenced by background noises etc. When the slider 420 is moved rightward, the estimation sensitivity becomes lower. In this case, for the sound source position estimation to be done, it is necessary for the volume of the sound from the sound source to be relatively high, but the sound source position estimation is hardly influenced by background noise. Accordingly, where the speaker is definitely identified as in lectures, it is desirable to set the estimation sensitivity at a relatively low value.

When the slider 422 of the estimation speed handling and display section 424 within the main operation section 400 is moved, the rate or speed of sound source position estimation done by the sound source position estimating function is changed. The estimation speed relates to a time constant of a filter for averaging (smoothing) the sound source position estimation results performed by the sound source position estimating function. As the estimation speed is higher, the time constant is smaller, and, therefore, change of the sound source position can be swiftly dealt with, while the sound source position estimation is liable to receive influences from noise etc. and the movement of the sound source mark 316 becomes intensive. On the other hand, when the estimation speed is low, the time constant is large, and, therefore, the change of the sound source position cannot be dealt with swiftly, but the sound source position estimation hardly receives influences from noise and, accordingly, the motion of the sound source mark 316 becomes stable. It should be noted that, leftward movement of the slider 422 causes the estimation speed to become higher, while rightward movement of the slider 422 decreases the estimation speed.

Figure 7:
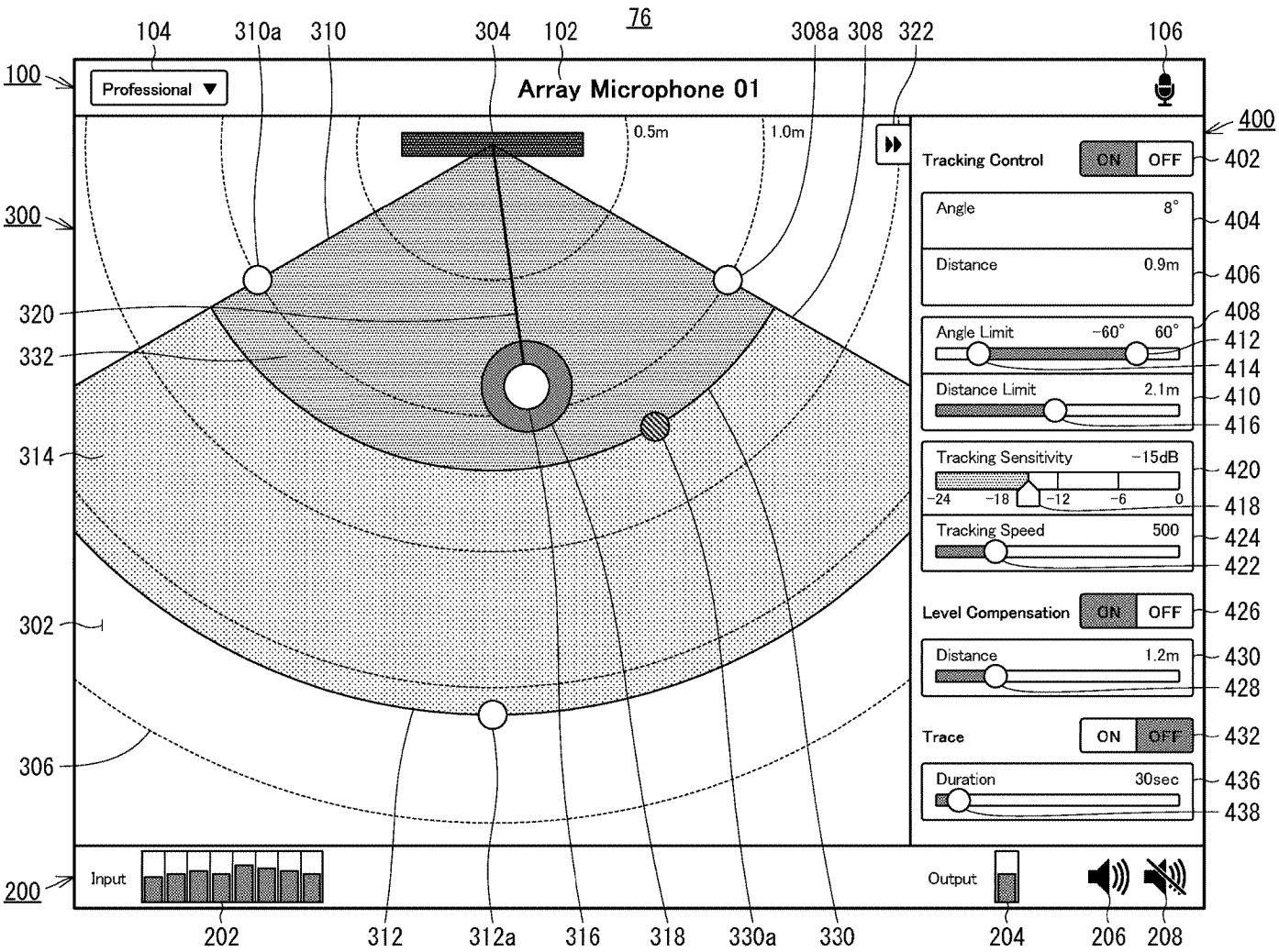
FIG. 7 is an illustration illustrating the control picture in a situation different from the one shown in FIG. 6.

When the level correction switching button 426 in the main operation section 400 is operated to turn on the level correcting function, an arcuate level correction executing distance boundary line 330 is displayed in the operating state display section 300, as shown in FIG. 7. The level correction executing distance boundary line 330 extends along a circle having its center at the reference position of the array mark 304, and has two opposite ends contacting the angle boundary lines 308 and 310, respectively. At an appropriate location on this level correction execution distance boundary line 330, a circular, for example, handling marker 330*a* is present. The handling marker 330*a* is used for handling the level correction execution distance boundary line 330, or, in other words, for altering the level correction execution distance in the real space.

When the position of the sound source comes nearer to the microphone array 30 than the level correction execution distance corresponding to the level correction execution distance boundary line 330, the levels of the audio signals from the microphone devices 32-1 through 32-8 are restricted depending on how near the sound source approaches the microphone array 30, or reduced at a rate of, for example, −6 dB per 1 m. With this arrangement, increase of the output signal level due to excessive approach of the sound source to the microphone array 30 is limited, and thereby a steady hearing environment is secured.

When the handling marker 330*a* attached to the level correction execution distance boundary line 330 is moved, the (radial) position of the level correction execution distance boundary line 330 is changed, and, as a result, the level correction execution distance is changed. Handling or moving the slider 428 attached to the level correction execution distance boundary line 330 also causes the (radial) position of the level correction execution distance boundary line 330 to be moved, and whereby the level correction execution distance is changed. A generally fan-shaped area 332 defined by the level correction execution distance boundary line 330 and the two angle boundary lines 308 and 310 may be colored or patterned as desired.

Figure 8:
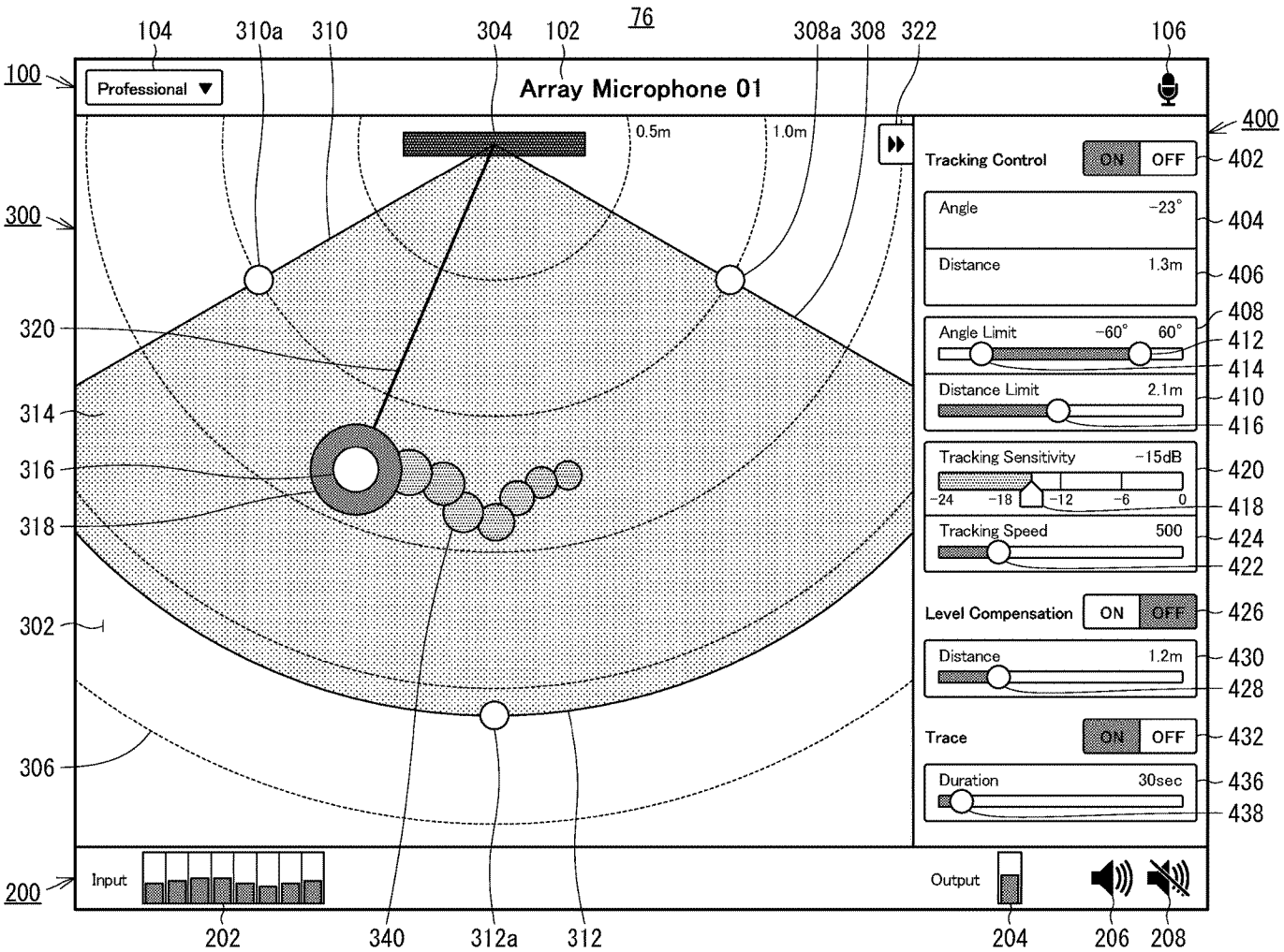
FIG. 8 is an illustration illustrating the control picture in a situation different from the one shown in FIG. 7.

When the tracing display switching button 432 in the main operation section 400 is operated to turn on the tracing display function, tracing marks 340 indicating the trace of the sound source (more specifically, the sound source marks 316) are displayed in the operating state display section 300, as shown in FIG. 8. The display duration of the tracing marks 340 can be changed by moving the slider 434 of the tracing display duration handling and display section 436. By seeing the tracing marks 340, the operator can intuitively grasp the route and range of motion of the sound source. This tracing display function is very useful in setting the directivity changeable range, for example, and, in particular, in setting the directivity changeable range as narrow as possible.

Figure 9:
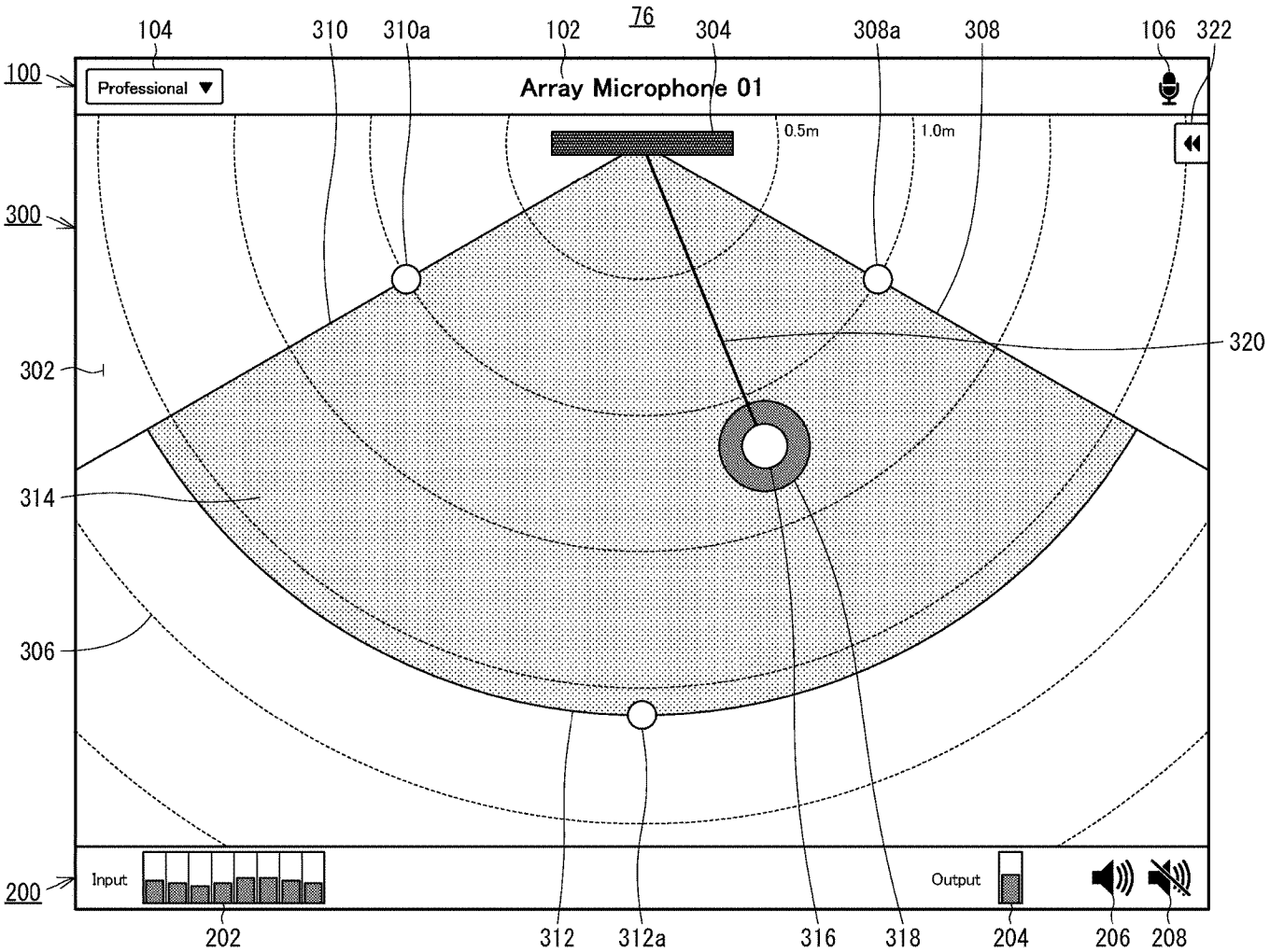
FIG. 9 is an illustration illustrating the control picture in a situation different from the one shown in FIG. 8.

In the display shown in FIG. 2, for example, when the main operation section display switching button 322 in the upper right corner of the operating state display section 300 is operated, the main operation section 400 is hidden, and the display of the operating state display section is enlarged, as shown in FIG. 9. In the display shown in FIG. 9, when the main operation section display switching button 322 is operated, the main operation section 400 is displayed again to return to the display shown in FIG. 2. Depending on various conditions including the case of whether it is necessary to use the main operation section 400, the display of the main operation section 400 can be turned on or off as desired.

Figure 10:
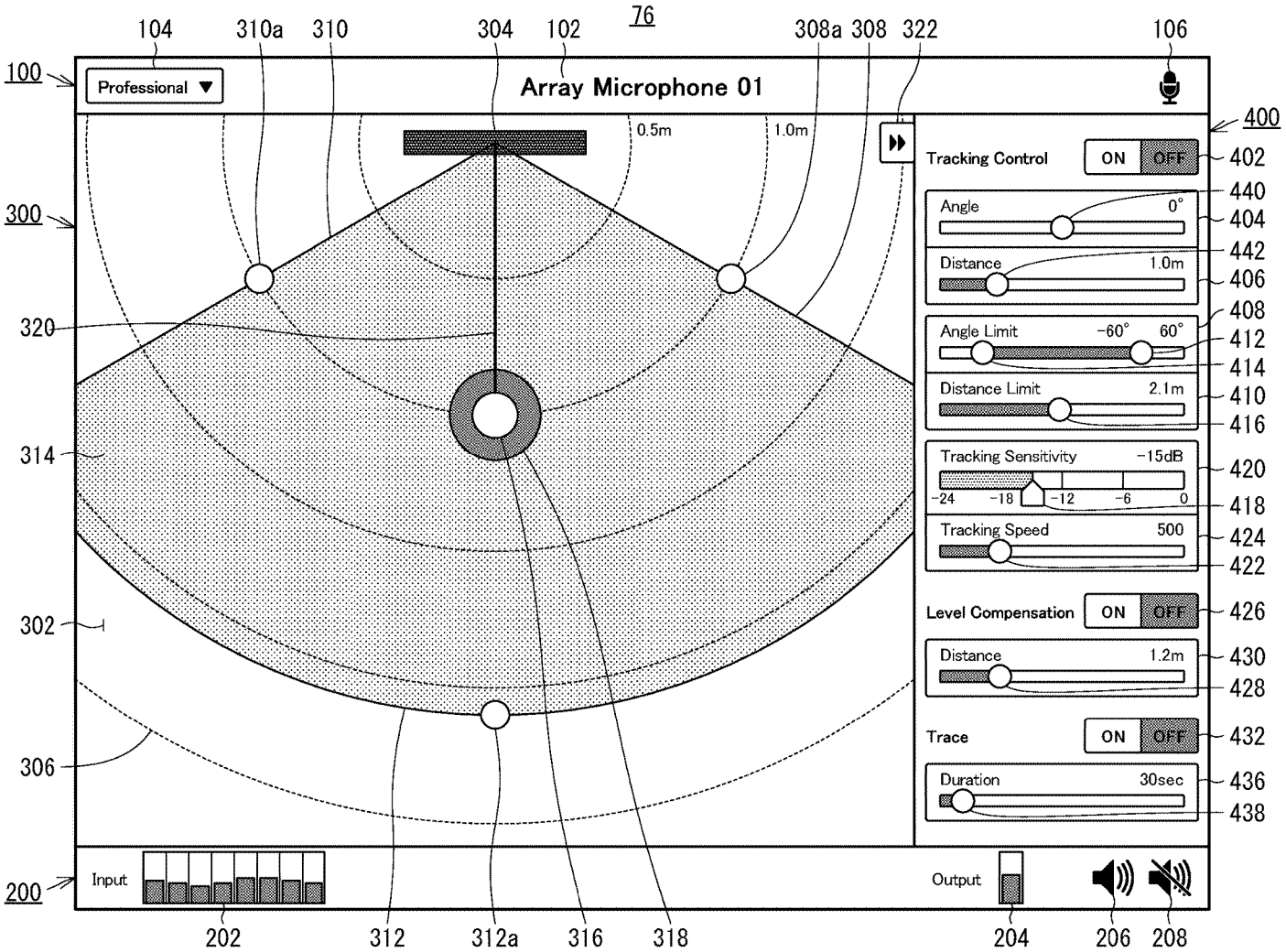
FIG. 10 is an illustration illustrating the control picture in a situation different from the one shown in FIG. 9.

Let it be assumed that, in the display shown in FIG. 2, for example, the directivity's tracking function is turned off as a result of operation of the control mode switching button 402 in the main operation section 400. This disables the directivity's tracking function so that the control mode is switched to the manual mode. In the manual mode, as shown in FIG. 10, a slider 440 is displayed in the sound source direction handling and display section 404, and also a slider 442 is displayed in the sound source distance handling and display section 406. These sliders 440 and 442 are for use in moving the sound source mark 316 to a desired position, and, when the sound source mark 316 is moved to a desired position by the operation of the sliders 440 and 442, the directivity of the microphone array 30 is controlled in accordance with the resultant position of the sound source mark 316. In other words, the sound source is treated as if it were in the position in the real space corresponding to the position of the sound source mark 316. The position of the sound source mark 316 treated as a so-to-say virtual sound source can be shifted as desired by moving the sound source 316 itself. It should be noted, however, the sound source mark 316 as the virtual sound source can be moved only within the directivity changeable range corresponding area 314, but cannot be moved outside the area 314. In this manual mode, when the directivity's tracking function is turned on again by operating the control mode switching button 402, the state shown in FIG. 2 is recovered and the system returns to the automatic mode.

When the volume control button (loudspeaker mark) 206 in the footer section 200 is operated, a slider (not shown) for use in controlling the volume is displayed. By moving the volume control slider, the volume can be controlled. In other words, the output signal level can be controlled.

When the muting switching button (the backslashed loudspeaker mark) 208 displayed rightward of the volume control button 206 is operated, the muting function is ON/OFF controlled. Each time the muting switching button 208 is operated, the muting function is alternately turned on and off.

Operating the termination button (mike button) 106, the microphone array program can be terminated.

Figure 11:
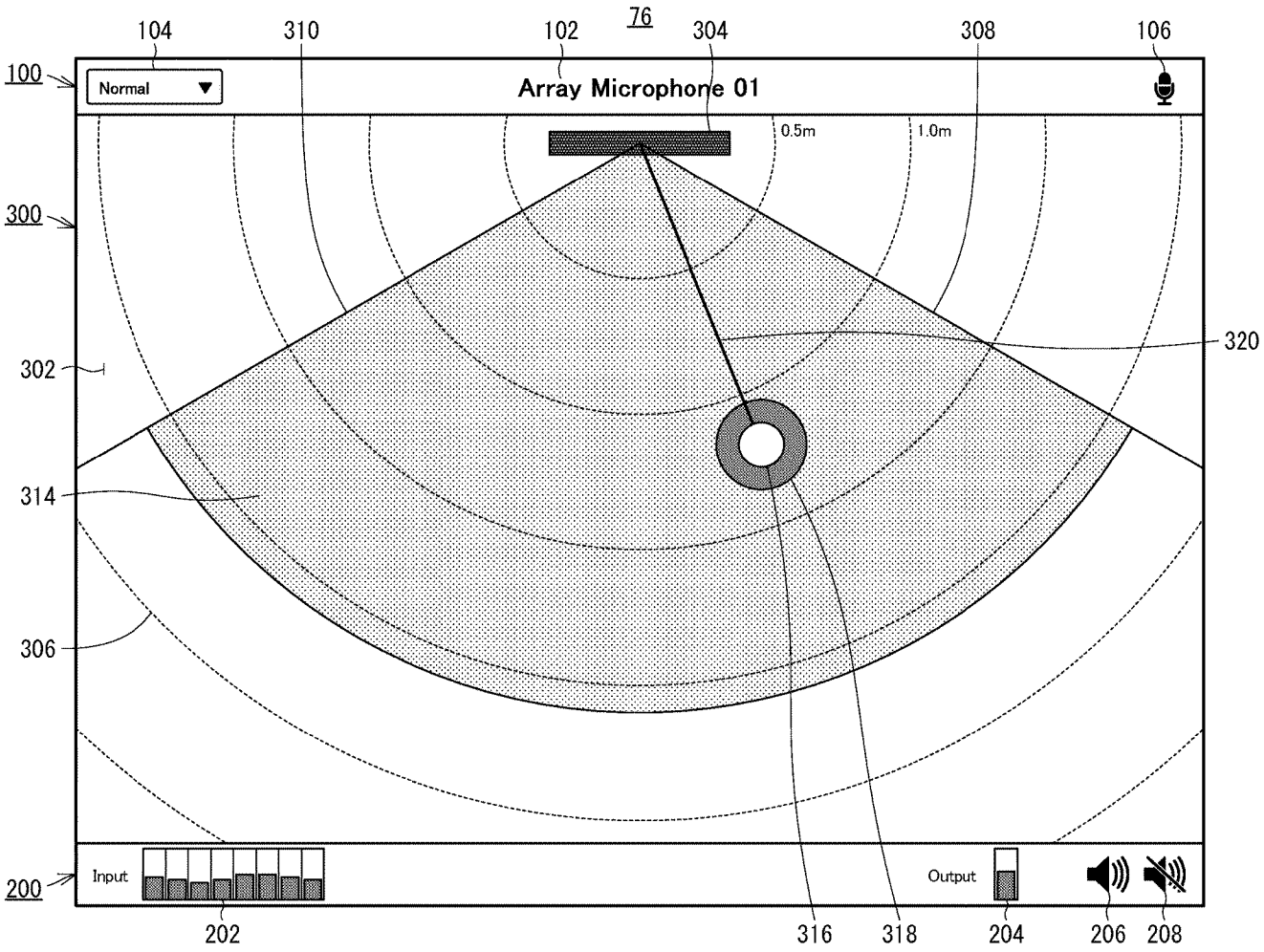
FIG. 11 is an illustration illustrating the control picture in a situation different from the one shown in FIG. 10.

Operating the user level switching button 104 in the header section 100, the user level can be switched. More specifically, there are two levels as the user level, one being a professional level and the other being a normal level. FIGS. 2 and 4 through 10 show control pictures when the professional level is selected. When the normal level is selected through the operation of the user level switching button 104, a picture shown in FIG. 11 is displayed. Specifically, the main operation section 400 disappears, and the handling markers 308*a*, 310*a* and 312*a* for use in handling (moving) the respective boundary lines 300, 310 and 312 in the operating state display section 300 disappear. In addition, the main operation display switching button 322 in the operating state display section 300 also disappears. In short, out of the operable components in the control picture, only the necessary, minimum components, namely, the termination button 106, the volume control button 206, the muting switching button 208 and the user level switching button 104, remain in the control picture. This avoids undesired operation or handling by any outsiders. It should be noted that, for switching the normal level control picture to the professional level through the operation of the user level switching button 104, a predetermined password is requested.

For performing the control of the microphone array by the above-described control system, the control system 70 (more specifically, the processor 72) and the microphone array 30 execute the following processing.

First, in the control system 70, the microphone control program is activated, causing the control picture shown in FIG. 2 etc. to be displayed on the display 76 after the aforementioned microphone array selecting picture is displayed. Then, the control system 70 executes a microphone data acquiring task illustrated in FIG. 12. This microphone data acquiring task is executed at predetermined time intervals of Ta (e.g. Ta=30 msec).

In the microphone data acquiring task, the control system 70 goes to Step S1 to transmit a request for microphone data to the microphone array 30. Then, the control system advances to Step S3 and waits for the microphone data sent from the microphone array 30 in response to the request.

Upon receipt of the microphone data from the microphone array 30 in Step S3, the control system 70 advances to Step S5 where it stores temporarily the microphone data received in Step S3. As described above, the microphone data contains the sound source position information (direction and distance) representing the sound source position estimated by the sound source position estimating function, the input level information representing the levels of the audio signals from the microphone devices 32-1 through 32-8, and the output level information representing the level of the output signal of the microphone array 30 as a whole.

Then, the control system 70 advances to Step S7 and renews the displayed content of the control picture in accordance with the latest microphone data stored in Step S5. Then, the control system 70 temporarily terminates the microphone data acquiring task, but, as described previously, the control system 70 executes repetitively the microphone data acquiring task at the time intervals Ta.

At the same time, the control system 70 executes the responding-to-operation task in response to operations on the control picture.

Figure 12:
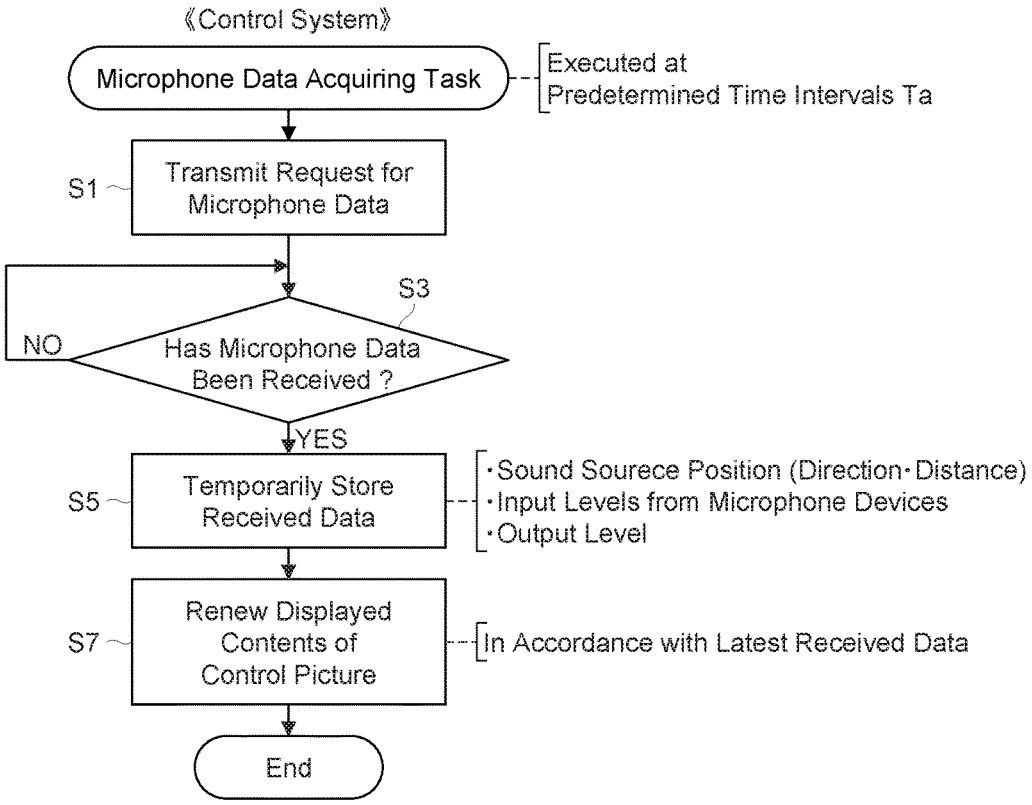
FIG. 12 is a flow chart showing a microphone data acquiring task executed by a control apparatus of the present embodiment.
Figure 13:
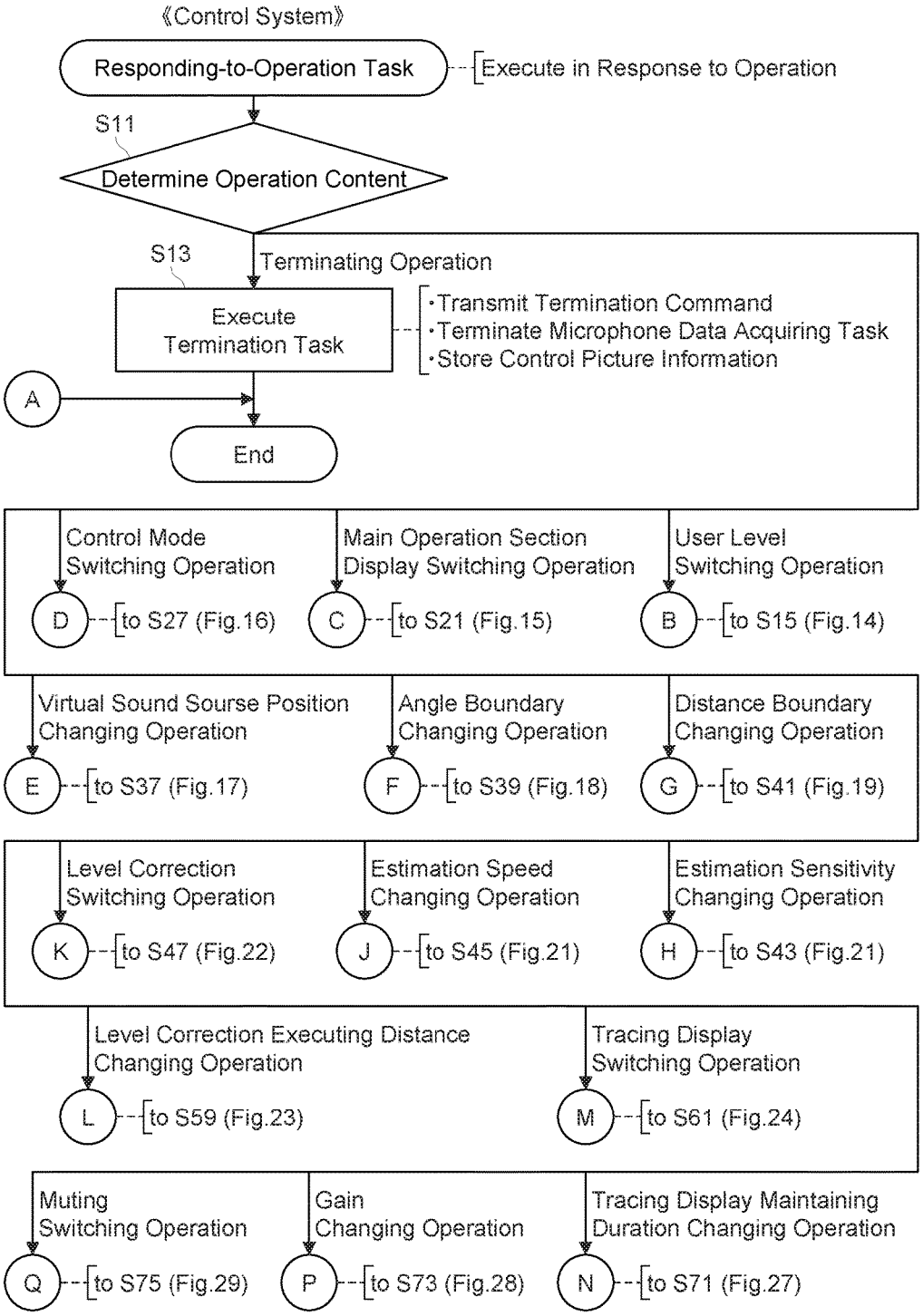
FIG. 13 is a flow chart showing the flow of a responding-to-operation task to be executed by the control apparatus of the present embodiment.

Specifically, as shown in FIG. 13, in the responding-to-operation task, the control system 70 first advances to Step S11 to determine the content of operation. If it is determined that the microphone array control program terminating operation has been done, or, in other words, the termination button 106 in the header section 100 is operated to terminate the microphone array control program, the control system 70 advances to Step S13 to execute a predetermined termination task. In this termination task, a termination command is transmitted to the microphone array 30, and the microphone data acquiring task described with reference to FIG. 12 is terminated. Furthermore, the information of the control picture immediately before the termination operation is done is stored. The responding-to-operation task is terminated by the execution of the termination task.

Figure 14:
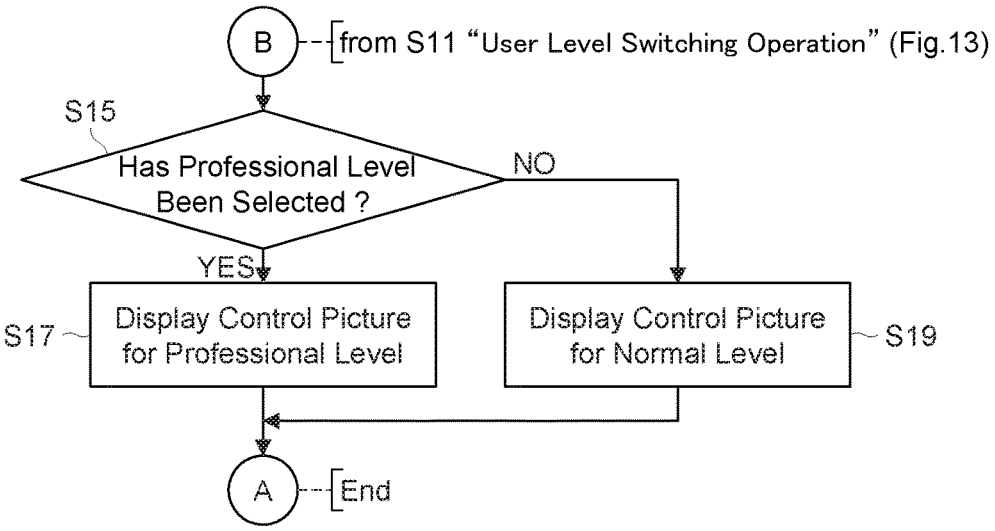
FIG. 14 is a flow chart continuing from the flow chart of FIG. 13.

When, in Step S11, it is determined that the user level switching operation has been done by operating the user level switching button 104 in the header section 100, the control system 70 advances to Step S15 shown in FIG. 14. Whether the professional level has been selected or not is judged in Step S15. If the professional level has been selected, the program advances to Step S17 in which the control picture for the professional level is displayed. Thus, the control pictures for the professional use like the ones shown in FIGS. 2, and 4-10 are displayed. The contents of the control picture for the professional use to be displayed in Step S17 are based on the contents of the immediately preceding control picture for the professional use. In case that the professional level is selected in the state in which the normal level has been used, it is requested to input a password as described previously. After the execution of Step S17, the control system 70 temporarily terminates the responding-to-operation task. On the other hand, if it is judged in Step S15 that the normal level has been selected, the program advances from Step S15 to Step 19. In Step 19, a control picture for the normal level as shown in FIG. 11 is displayed, and, after the execution of Step S19, the responding-to-operation task is temporarily terminated.

Figure 15:
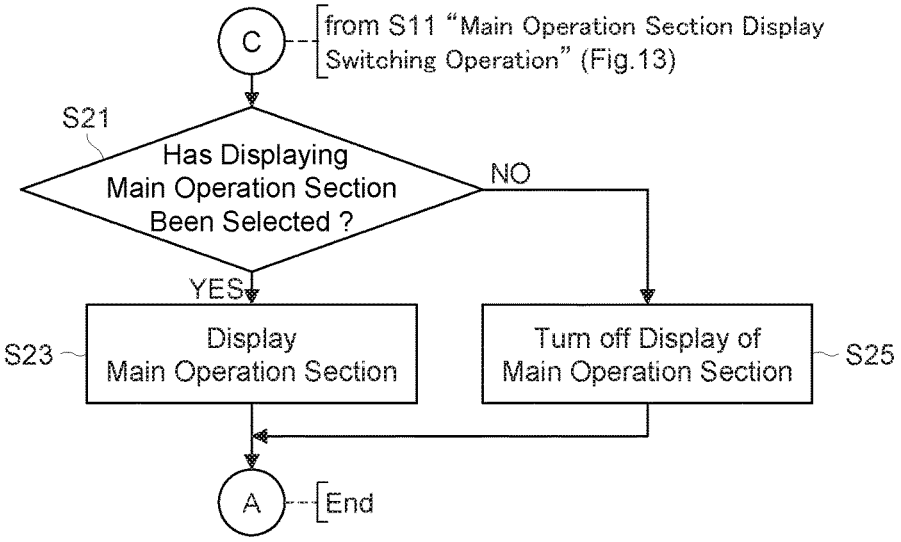
FIG. 15 is still other flow chart continuing from FIG. 13.

If, in Step S11 in FIG. 13, it is determined, for example, that the main operation section display switching operation has been done, or, more specifically, the main operation section display switching button 322 in the upper right portion of the operating state display section 300 has been operated, the control system 70 advances to Step S21 in FIG. 15. Step S21 is for judging whether or not the operation of the main operation section display switching button 322 is for selecting the main operation section 400. If the operation of the main operation section display switching button 322 is for selecting displaying the main operation section 400, the control system 70 advances to Step S23. The control system 70 temporarily terminates the responding-to-operation task after displaying the main operation section 400 on the control picture. On the other hand, if, in Step S21, it is judged that the operation of the main operation section display switching button 322 is for selecting turning off of the display of the main operation section 400, the control system 70 advances from Step S21 to Step S25. In Step S25, the display of the main operation section 400 is turned off, as shown in FIG. 9, and the responding-to-operation task is temporarily terminated.

Figure 16:
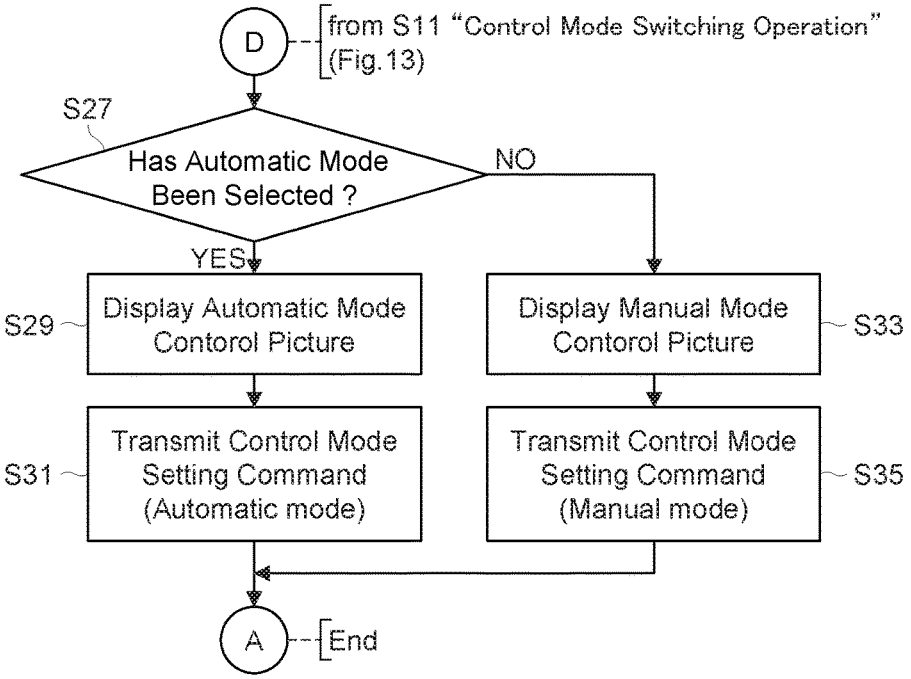
FIG. 16 is still other flow chart continuing from FIG. 13.

When it is determined, in Step S11 shown in FIG. 13, that the control mode switching operation is selected, or, more specifically, the control mode switching button 402 in the main operation section 400 is operated, the control system 70 advances to Step S27 shown in FIG. 16. In Step S27, whether or not the automatic mode has been selected, or, in other words, whether or not the directivity's tracking function has been turned on is judged. If it is judged that the automatic mode has been selected, or, in other words, the directivity's tracking function has been turned on, the control system 70 advances to Step S29, in which the control picture for the automatic mode like the ones shown in FIGS. 2 and 4 is displayed, and the control system 70 advances to Step S31. In Step S31, a control mode setting command to set the automatic mode is transmitted to the microphone array 30. After that, the control system 70 temporarily terminates the current responding-to-operation task. On the other hand, if it is judged, in Step S27, the manual mode has been selected, or, in other words, the directivity's tracking function is turned off, the control system 70 advances from Step S27 to Step 33, in which the control picture for the manual mode like the one shown in FIG. 10 is displayed, and, thereafter, the control system 70 advances to Step S35. In Step S35, a control mode setting command to set the manual mode is transmitted to the microphone array 30. After that, the control system 70 temporarily terminates the current responding-to-operation task.

Figure 17:
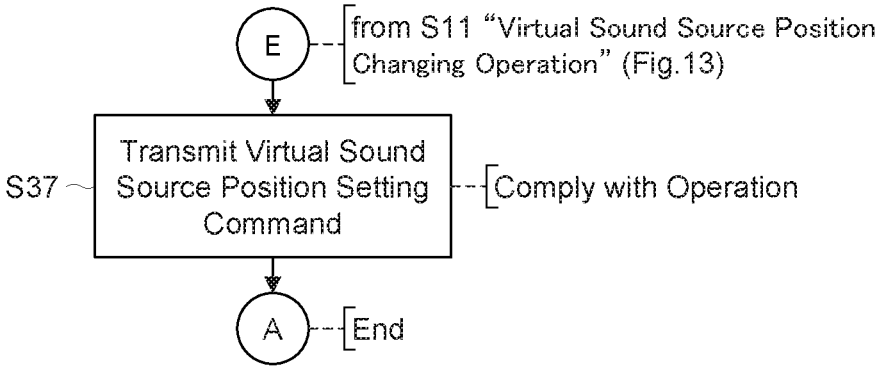
FIG. 17 is still other flow chart continuing from FIG. 13.

Now, reference is to be made to FIG. 13 again. In Step S11, if it is determined that a virtual sound source position changing operation has been done, or, in other words, if it is determined that the sliders 440 in the sound source direction handling and display section 404 and the slider 442 in the sound source distance handling and display section 406 in the main operation section 400 have been moved, or the sound source mark 316 in the operating state display section 300 has been moved in the manual mode as illustrated in FIG. 10, the control system 70 advances to Step S37 shown in FIG. 17. In Step S37, a virtual sound source position setting command in response to the moving operation of the sliders 440 and 442 or the moving operation of the sound source mark 316 is transmitted to the microphone array 30. For example, when the sound source mark 316 is moved, the virtual sound source position setting command containing information representing the relative angle between the array mark 304 and the sound source mark 316 corresponding to the amount of movement of the sound source mark 316 is transmitted to the microphone array 30, and the control system 70 temporarily terminates the responding-to-operation task. The microphone array 30 performs delay processing in accordance with the virtual sound source position setting command, to thereby orient the directivity to the sound source position in accordance with the command.

Figure 18:
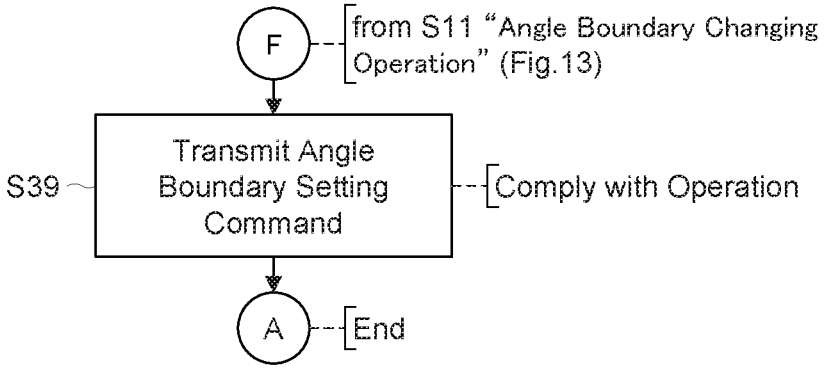
FIG. 18 is still other flow chart continuing from FIG. 13.

If it is determined, in Step S11 in FIG. 13, that the angle boundary changing operation has been done, or, more specifically, the markers 308*a* and 310*a* associated with the respective angle boundary lines 308 and 310 in the operating state display section 300 have been moved, or the sliders 412 and 414 of the angle boundary handling and display section 408 in the main operation section 400 have been moved, the control system 70 advances to Step S39 shown in FIG. 18. In Step S39, an angle boundary setting command according to the moving, or operation, of the markers 308*a* and 310*a* or the sliders 412 and 414 is transmitted to the microphone array 30. For example, when the markers 308*a* and 310*a* are moved, the angle boundary setting command containing information representing the directivity changing limit angles θ1 and θ2 is transmitted to the microphone array 30. Then, the control system 70 temporarily terminates the responding-to-operation task. The microphone array 30 restricts the directivity's tracking function in accordance with the angle boundary setting command.

Figure 19:
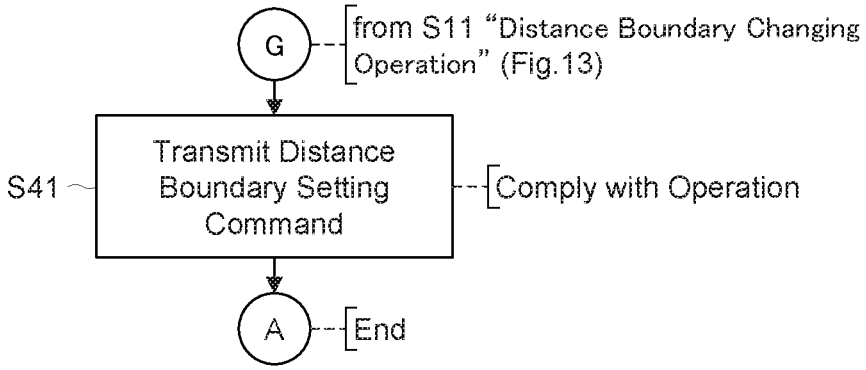
FIG. 19 is still other flow chart continuing from FIG. 13.

If it is determined, in Step S11 shown in FIG. 13, that the distance boundary changing operation has been done, or, more specifically, that the handling marker 312*a* attached to the distance boundary line 312 in the operating state display section 300 has been moved, or the slider 416 in the distance boundary handling and display section 410 in the main operation section 400 has been moved, the control system 70 advances to Step S41 shown in FIG. 19. In Step S41, a distance boundary setting command corresponding to the movement of the marker 312*a* or slider 416 is transmitted to the microphone array 30. If the marker 312*a* has been moved, a distance boundary setting command including information representing the distance from the array mark 304 to the distance boundary line 312, or, in other words, representing the radius of the directivity changeable range corresponding area 314, is transmitted to the microphone array 30. The distance from the array mark 304 to the distance boundary line 312 (i.e. the radius of the area 314 corresponding to the directivity changeable range) referred to herein desirably is the value resulting from conversion, by the use of the aforementioned conversion coefficient, to the distance from the microphone array 30 in the real space. Then, the control system 70 temporarily terminates the responding-to-operation task. The microphone array 30 now restricts the directivity's tracking function in accordance with this distance boundary setting command.

Figure 20:
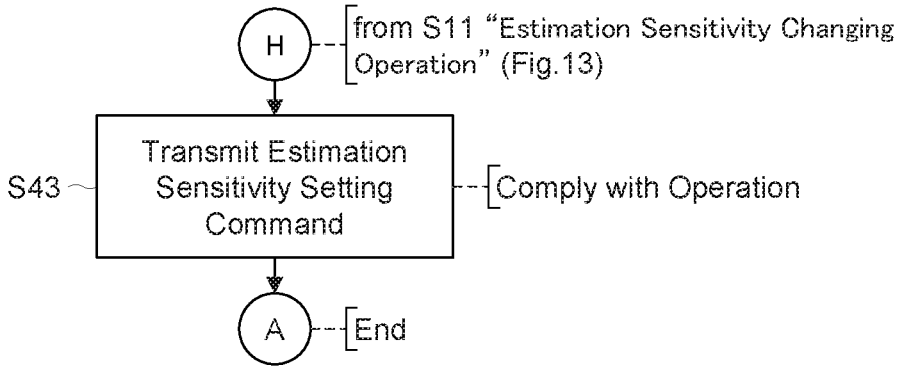
FIG. 20 is still other flow chart continuing from FIG. 13.

If it is determined, in Step S11 in FIG. 13, that an estimation sensitivity changing operation has been done, or, more specifically, the slider 418 of the estimation sensitivity handling and display section 720 in the main operation section 400 has been moved, the control system 70 advances to Step S43 shown in FIG. 20. In Step S43, an estimation sensitivity setting command containing a sensitivity level corresponding to the movement of the slider 418 is transmitted to the microphone array 30, and, thereafter, the responding-to-operation task is temporarily terminated.

Figure 21:
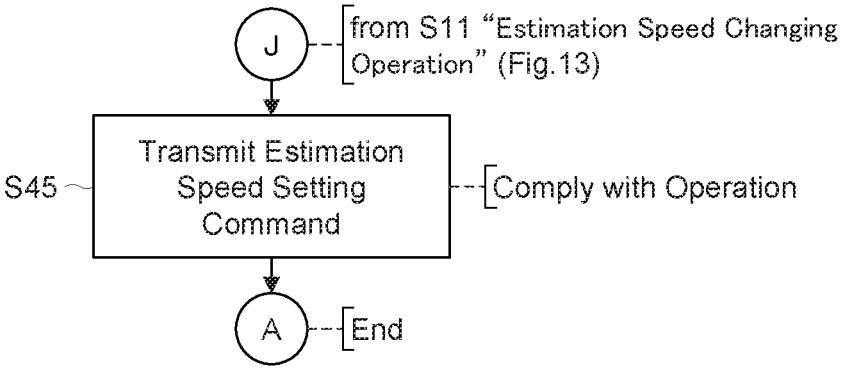
FIG. 21 is still other flow chart continuing from FIG. 13.

If it is determined, in Step S11 in FIG. 13, that the estimation speed changing operation has been done, or more specifically, the slider 422 of the estimation speed handling and display section 424 has been moved, the control system 70 advances to Step S45 shown in FIG. 21. In Step S45, an estimation speed setting command corresponding to the movement of the slider 422 is transmitted to the microphone array 30, and this responding-to-operation task is temporarily terminated.

Figure 22:
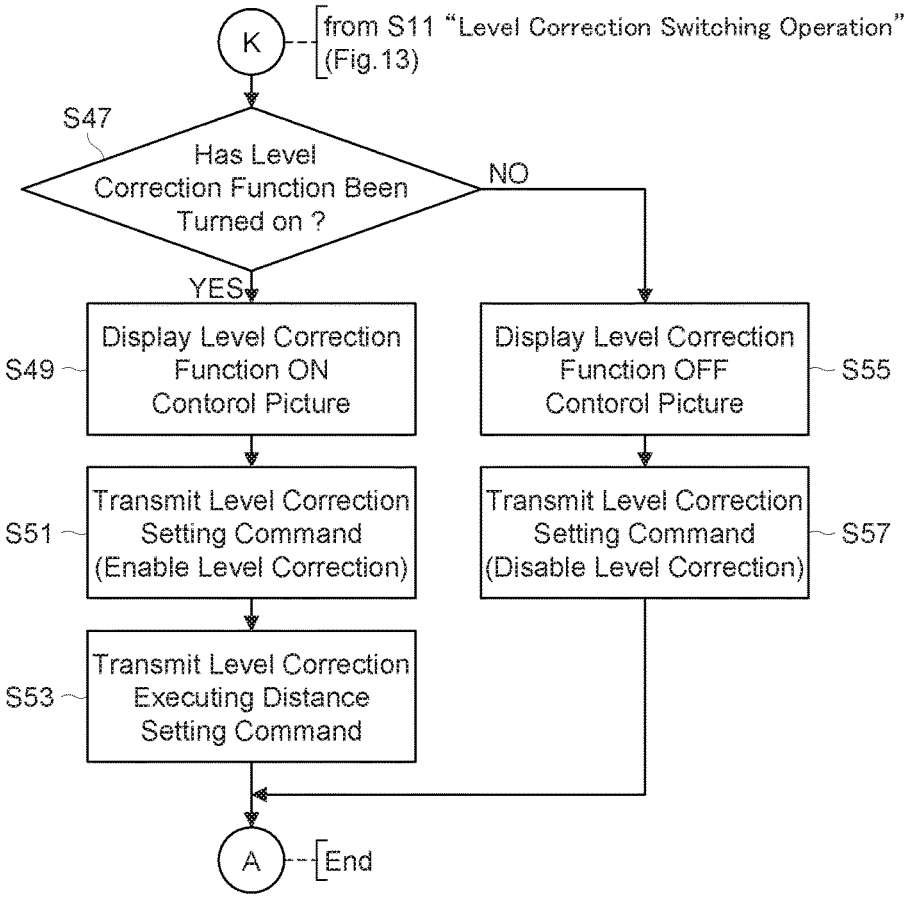
FIG. 22 is still other flow chart continuing from FIG. 13.

If it is determined, in Step S11 shown in FIG. 13, that the level correction switching operation has been done, or, more specifically, the level correction switching button 426 in the main operation section 400 has been operated, the control system 70 advances to Step S47 shown in FIG. 22. In Step S47, whether or not the level correction function has been turned on is judged. If it has been judged that the level correction function has been turned on, the control system 70 advances to Step S49. In Step S49, the control picture as shown in FIG. 7 for use when the level correction function is on, is displayed, and, thereafter, the control system 70 advances to Step S51. In Step S51, a level correction setting command for turning on the level correction function is transmitted to the microphone array 30, and the control system 70 advances further to Step S53. In Step S53, the control system 70 transmits to the microphone array 30 a level correction executing distance setting command to set the immediately preceding level correction executing distance, and, thereafter, temporarily terminates the responding-to-operation task. On the other hand, if it is determined in Step S47 that the level correction function has been turned off, the control system 70 advances from Step S47 to Step S55, wherein the control picture to be used when the level correction function is off is displayed, and, thereafter, advances to Step S57. In Step S57, a level correction setting command to turn off the level correction function is transmitted to the microphone array 30, and the responding-to-operation task is temporarily terminated.

Figure 23:
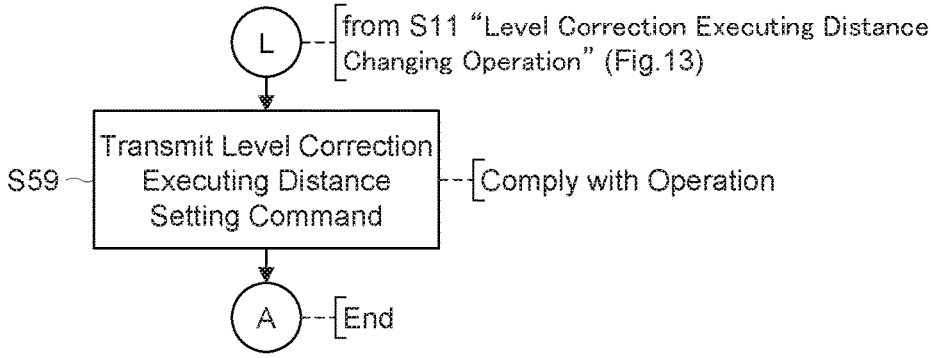
FIG. 23 is still other flow chart continuing from FIG. 13.

If it is determined in Step S11 shown in FIG. 13 that an operation to change the level correction executing distance has been done, or, more specifically, that, while the level correction function is on, the slider 428 of the level correction executing distance handling and display section 430 has been operated, or moved, or the marker 330*a* attached to the level correction distance boundary line 330 in the operating state display section 300 has been moved, the control system 70 advances to Step S59 shown in FIG. 23. In Step S59, a level correction executing distance setting command corresponding to the moving operation of the slider 428 or marker 330*a* is transmitted to the microphone array 30. For example, when the marker 330*a* has been moved, the level correction execution setting command containing information representing the distance from the array mark 304 to the level correction executing distance boundary line determined in accordance with the amount of movement of the marker 330*a*, i.e. the radius of generally fan-shaped area 332, is transmitted to the microphone array 30. It is desirable that the distance from the array mark 304 to the level correction executing boundary line (i.e. the radius of the generally fan-shaped area 332) is the value resulting from converting it, using the aforementioned conversion coefficient, to the distance from the microphone array 30 in the real space. After that, the control system 70 temporarily terminates the responding-to-operation task. The microphone array 30 sets the level correction executing distance based on the level correction executing distance setting command.

Figure 24:
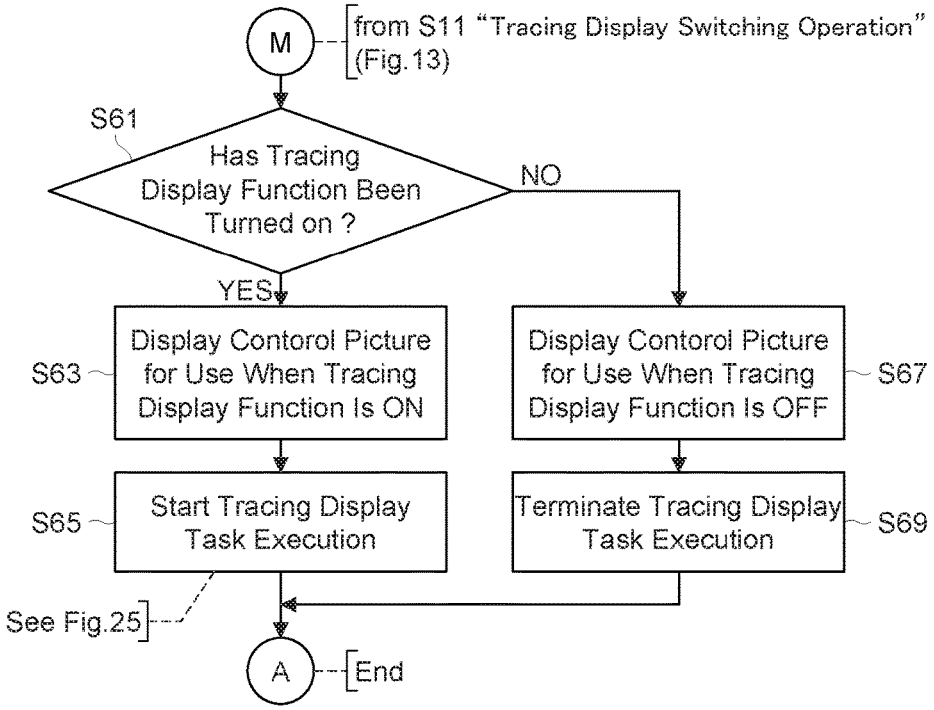
FIG. 24 is still other flow chart continuing from FIG. 13.

If it is determined in Step S11 in FIG. 13 that the tracing display switching operation has been done, or, more specifically, that the tracing display switching button 432 in the main operation section 400 has been operated, the control system 70 advances to Step S61 shown in FIG. 24, in which whether or not the tracing display function has been turned on is judged. If it is judged that the tracing display function has been turned on, the control system 70 advances to Step S63, in which the control system 70 causes the control picture for use when the tracing display function is on like the one shown in FIG. 8 to be displayed and, after that, advances to Step S65. In Step S65, the control system 70 starts executing the later-mentioned tracing display task and temporarily terminates the responding-to-operation task. If, on the other hand, it is judged in Step S61 that the tracing display function has been turned off, the control system 70 advances from Step S61 to Step S67, in which the control system 70 displays a control picture like the one shown in FIGS. 2 and 4 for use when the tracing display function has been turned off. After that, the control system 70 advances to Step S69 wherein it terminates the tracing display task, and thereafter temporarily terminates the responding-to-operation task.

Figure 25:
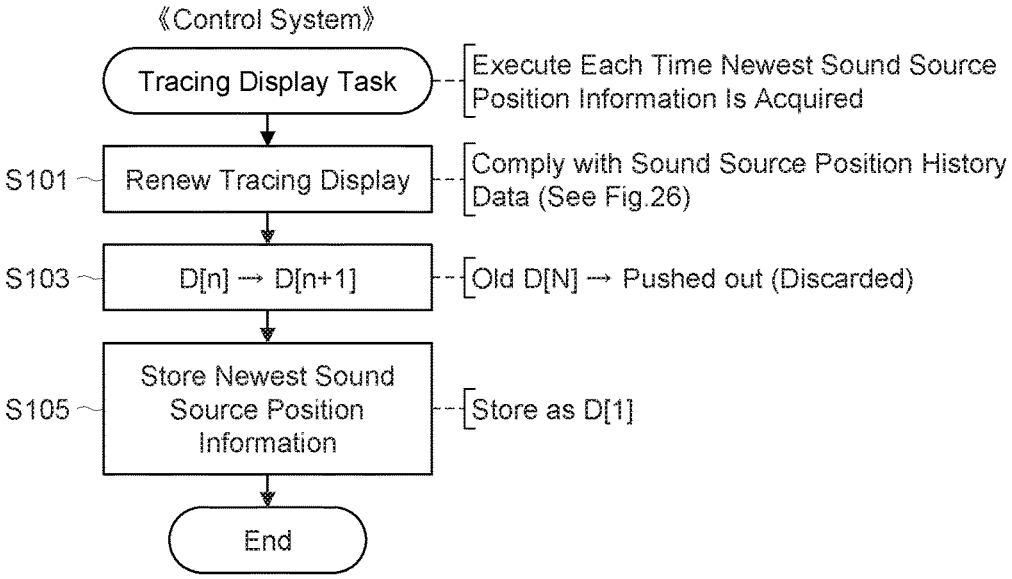
FIG. 25 is a flow chart showing the flow of a tracing display task to be executed by the control apparatus in the present embodiment.

Now, referring to FIG. 25, the tracing display task is described. In the tracing display task, the control system 70 advances to Step S101 where it renews the display of the tracing marks 340. The renewal of the tracing marks 340 is done based on sound source position history data like the one shown in FIG. 26. The sound source position history data is a set of N pieces of sound source position information D[n] (where n=1~N in the stored order) stored in the last time period Tb. The sound source position information D[n] with a larger value of n is older. That is, the sound source position information D[N] is the oldest, and the sound source position information D[1] is the newest. The tracing marks 340 are displayed based on the sound source position history data. In other words, the tracing marks 340 are displayed at respective ones of the positions corresponding to the respective pieces of sound source position information D[1]-D[N] in the operating state display section 300. Each time the newest piece of sound source position information D[1] is provided, the sound source position history data is renewed. On renewal, the oldest piece of sound source position history information D[N] is pushed out and discarded. The sound source position history data is held in the memory circuit 74.

Returning to FIG. 25, after the display of the tracing marks 304 is renewed in Step S101, the control system 70 advances to Step S103, where it renews the sound source position history data D[n] by causing the oldest sound source position information D[N] in the currently stored sound source position history data D[n] to be pushed out and shifting the remaining pieces of the sound source position information D[1] through D[N−1] by one in such a manner that D[n] changes to D[n+1] and so on. Then, the control system 70 advances to Step S105 where the newest sound source position information is stored as D[1] and temporarily terminates this tracing display task. After that, each time the newest piece of sound source position information D[1] is acquired, the tracing display task is executed at time intervals in synchronism with the time intervals Ta at which the microphone data acquiring task is executed. The execution of the tracing display task causes plural sound source positions consecutively acquired from the microphone array 30 over the predetermined time period of Ta to be displayed on the control picture (in the operating state display section 300).

Figure 27:
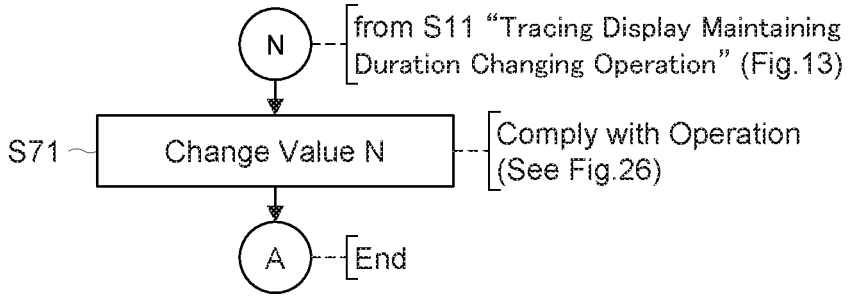
FIG. 27 is still other flow chart continuing from FIG. 13.

Returning to Step S11 shown in FIG. 13, if it is determined that a tracing display duration changing operation has been done in Step S11, or, more specifically, the slider 434 in the tracing display duration handling and display section 436 in the main operation section 400 is moved while the tracing display function is turned on, the control system 70 advances to Step S71 shown in FIG. 27, where the control system 70 changes the total number [N] of the pieces of sound source position information D[n] which form the sound source position history data shown in FIG. 26, in accordance with the movement of the slider 434, whereby the time period Tb is changed, or, in other words, the tracing display time duration is changed. It should be noted that as the total number N is larger, the tracing display duration is longer. After executing Step S71, the control system 70 temporarily terminates the responding-to-operation task.

Figure 28:
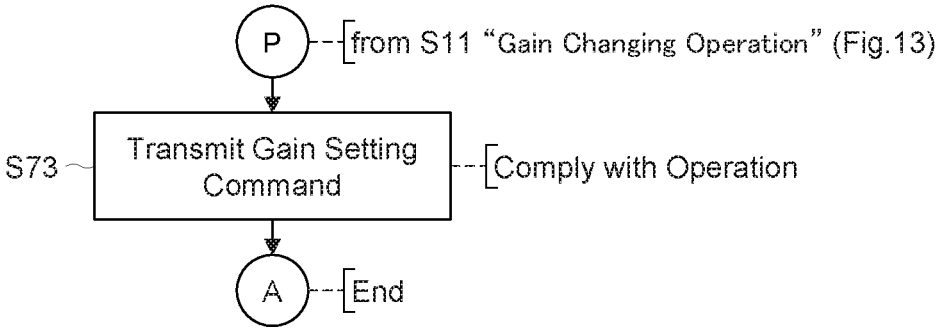
FIG. 28 is still other flow chart continuing from FIG. 13.

When it is determined in Step S11 shown in FIG. 13 that a gain changing operation has been done, or, more specifically, the volume control button 206 in the footer section 200 has been operated, the control system 70 advances to Step S73 shown in FIG. 28. In Step 73, the control system 70 causes a command to set the gain in accordance with the operation of the volume control button 206 to be transmitted to the microphone array 30. Then, the control system 70 temporarily terminates the responding-to-operation task.

Figure 29:
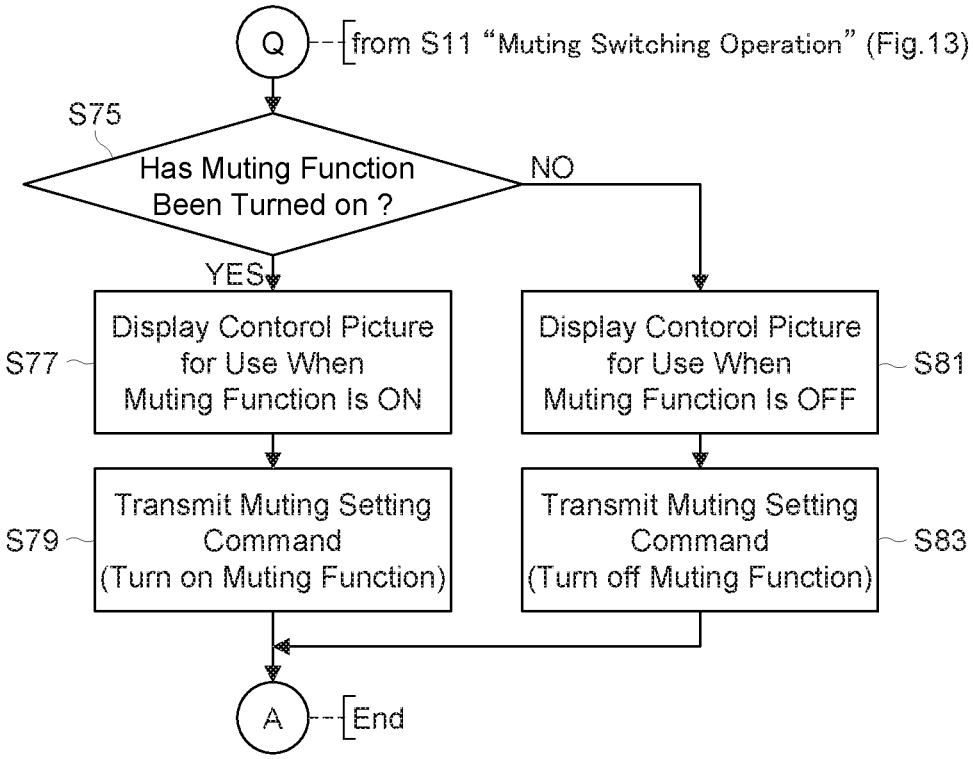
FIG. 29 is still other flow chart continuing from FIG. 13.

When it is determined in Step S11 shown in FIG. 13 that a muting switching operation has been done, or, more specifically, the muting switching button 208 displayed in the footer section 200 is operated, the control system 70 advances to Step S75 shown in FIG. 29, in which the control system 70 judges whether or not the muting switching operation is for turning on the muting function. If the muting switching operation is to turn on the muting function, the control system 70 advances to Step S77 to cause a control picture for use when the muting function is on to be displayed, in which the muting switching button 208 is distinctively displayed. Then, the control system 70 advances to Step S79 and transmits a muting setting command to the microphone array 30 to turn on the muting function. Then, the control system 70 temporarily terminates the responding-to-operation task. On the other hand, if it is judged in Step S75 that the muting switching operation is for turning off the muting function, the control system 70 advances from Step S75 to Step S81, in which the control picture for use when the muting function is off is displayed, in which the muting switching button 208 is displayed, for example, translucent (pale). Then, in Step S83, a muting setting command for turning off the muting function is transmitted to the microphone array 30, and the responding-to-operation task is temporarily terminated.

In response to the described processing by the control system 70, the microphone array 30 executes the following processing.

Figure 30:
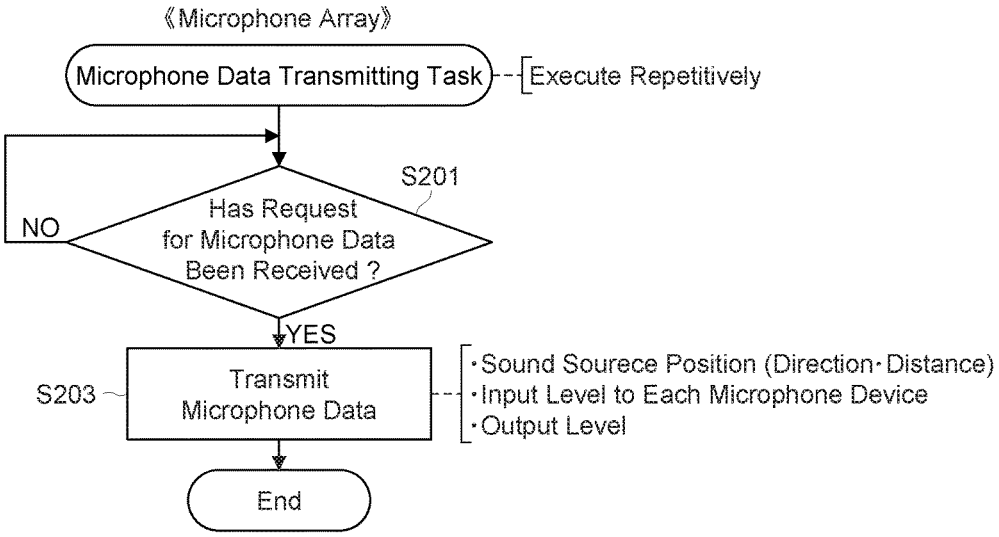
FIG. 30 is a flow chart showing the flow of a microphone data transmitting task to be executed by the microphone array in the present embodiment.

When power is supplied to the microphone array 30, it executes repetitively a microphone data transmitting task shown in FIG. 30. In the microphone data transmitting task, the microphone array 30 first advances to Step S201 and waits for a request for microphone data from the control system 70. When receiving the request for microphone data, the microphone array 30 advances to Step S203 and transmits the microphone data to the control system 70 in response to the request for microphone data. The microphone array 30 then temporarily terminates the microphone data transmitting task.

At the same time, the microphone array 30 executes a sound source position estimating task to perform the sound source position estimating function. More specifically, the microphone array 30 estimates the sound source position in the later-mentioned Step S321 based on an input signal exceeding the predetermined reference level held in the microphone array 30. The speed at which the sound source position is estimated is depending on the time constant of the aforementioned filter. The sound source position information as estimated by the sound source position estimating function is reflected in the above-mentioned microphone data.

The microphone array 30 also executes a responding-to-command task in response to a command from the control system 70.

Figure 31:
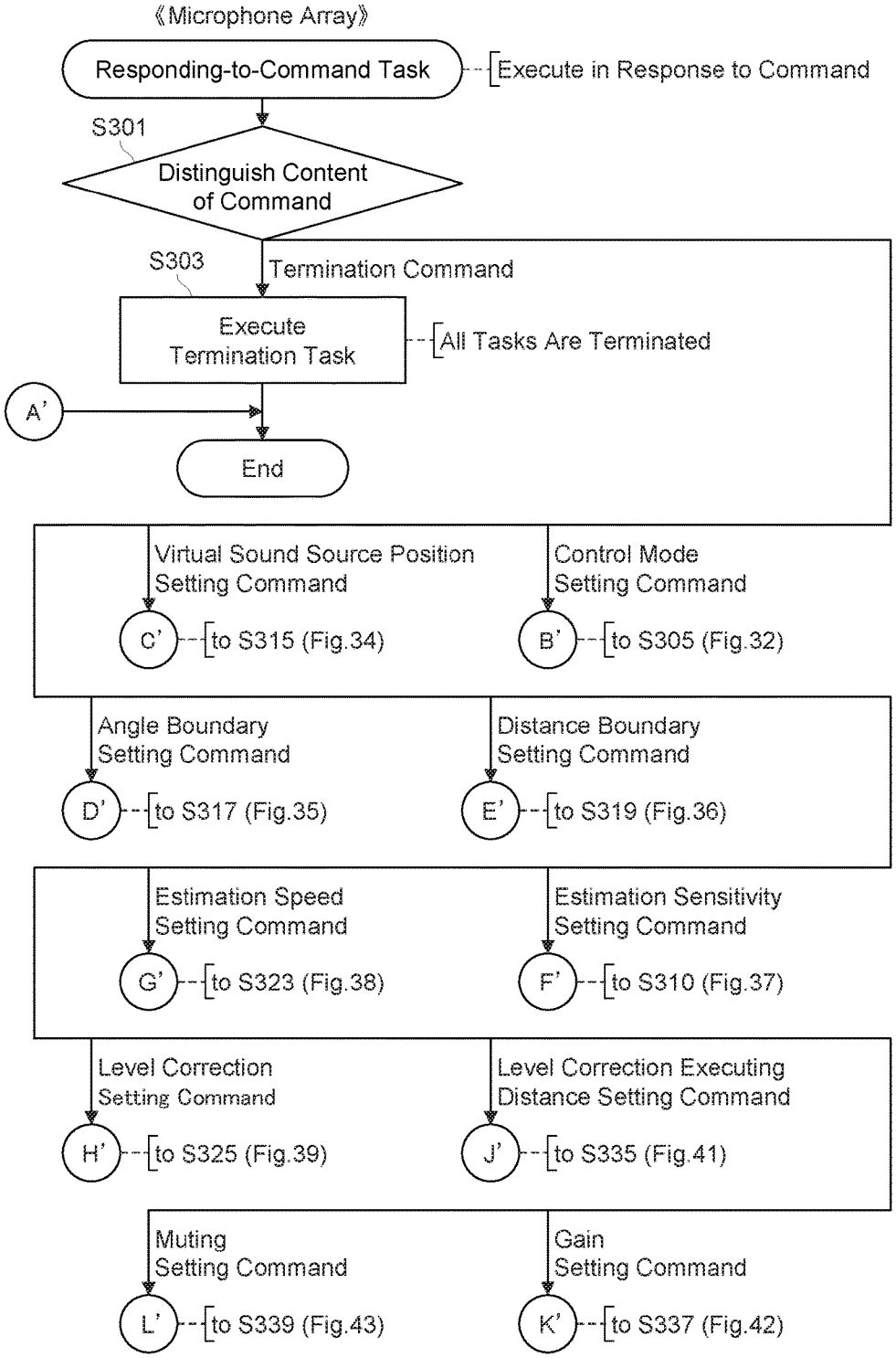
FIG. 31 is a flow chart showing the flow of a responding-to-command task to be executed by the microphone array in the present embodiment.

Specifically, as shown in FIG. 31, in the responding-to-command task, the microphone array 30 advances first to Step S301 to distinguish the content of the command. When the microphone array 30 has received, for example, a termination command to terminate the microphone array control program (see Step S13 in FIG. 13), the microphone array 30 advances to Step S303 and executes a predetermined termination task. Although not described in detail, this termination task operates to terminate all the tasks being executed then. The responding-to-command task is terminated upon the execution of the termination task.

Figure 32:
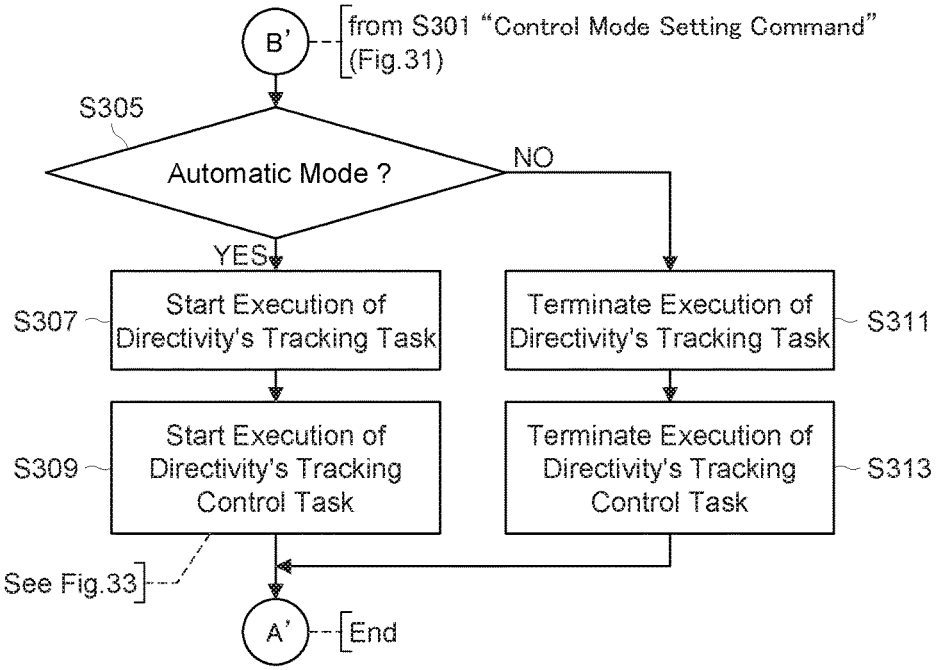
FIG. 32 is a flow chart continuing from FIG. 31.

If it is determined in Step S301 shown in FIG. 13 that a control mode setting command (see Step S31 or S35 shown in FIG. 16) has been received, the microphone array 30 advances to Step S305 in FIG. 32. In Step S305, whether or not the received command is to set the automatic mode, or, in other words, whether or not the command is to turn on the directivity's tracking function, is judged. If it is judged that to set the automatic mode is commanded, or to turn on the directivity's tracking function is commanded, the microphone array 30 advances to Step S307. In Step S307, the execution of the directivity's tracking task is started to turn on the directivity's tracking function. While the directivity's tracking function is ON, the microphone array 30 controls the amounts of delay to be provided for the individual ones of the input signals from the microphone devices 32-1 through 32-8 by the delaying processing based on the angle as estimated by the sound source position estimating function, to thereby cause the directivity to track the sound source. Detailed description of the directivity's tracking function is omitted. Thereafter, the microphone array 30 advances to Step S309, where it starts execution of a later-mentioned directivity's tracking control task, and temporarily terminates the responding-to-command task. On the other hand, if it is judged in Step S305 that the manual mode is commanded, or, in other words, disablement of the directivity's tracking function is commanded, the microphone array 30 advances from Step S305 to Step S311 and terminates the execution of the directivity's tracking task. This turns off the directivity's tracking function. Then, the microphone array 30 advances to Step S313, where the execution of the directivity's racking control task is terminated. Thereafter, the microphone array 30 temporarily terminates the responding-to-command task.

Figure 33:
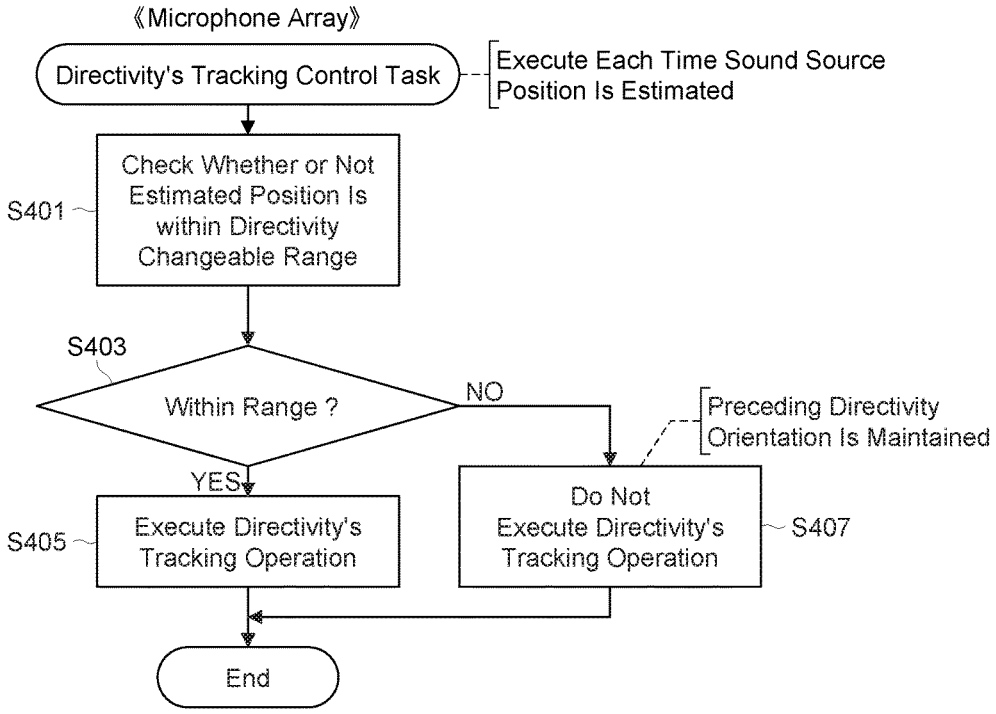
FIG. 33 is a flow chart of a directivity's tracking control task executed by the microphone array in the present embodiment.

Now, referring to FIG. 33, the directivity's tracking control task is described. The directivity's tracking control task is executed each time the sound source position estimating function (or the sound source position estimating task) estimates the position of the sound source. In this directivity's tracking control task, the microphone array 30 advances to Step S401, where it is judged whether or not the estimated sound source position is within the directivity changeable range. More specifically, the angle and distance relating to the estimated sound source position are compared with the reference angle and the reference distance held in the later-mentioned Step S317 and Step S319, respectively. If the angle relating to the estimated sound source position is within the reference angle and the distance relating to the estimated sound source position is within the reference distance, it is confirmed that the estimated sound source position is within the directivity changeable range, and, otherwise, the estimated sound source position is outside the directivity changeable range. If it is judged in Step S403 that the estimated sound source position is within the directivity changeable range, the microphone array 30 advances to Step S405 to cause the tracking to be executed by the directivity's tracking function (the directivity's tracking task), and terminates temporarily the directivity's tracking control task. On the other hand, if it is judged in Step S403 that the sound source position is not within the directivity's changeable range, the microphone array 30 advances to Step S407, where the tracking action by the directivity's tracking function is commanded not to be executed. In such case, the previously determined amounts of delay to be provided for the input signals from the microphone devices 32-1 through 32-8 through the delay processing are retained, and, as a result, the previous orientation of the directivity is retained. Thereafter, the directivity's tracking control task is temporarily terminated.

Figure 34:
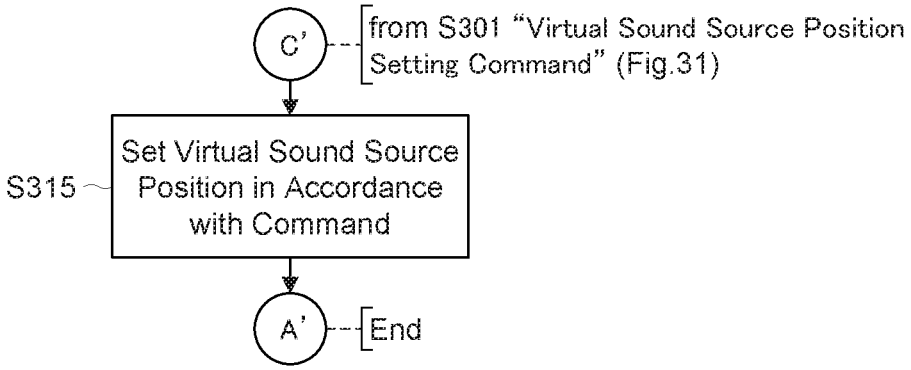
FIG. 34 is other flow chart continuing from FIG. 31.

Returning to Step S301 in FIG. 31, if it is determined in Step S301 that a virtual sound source position setting command (see Step S37 in FIG. 17) has been received, the microphone array 30 advances to Step S315 in FIG. 34, in which the virtual sound source position corresponding to the virtual sound position setting command, or the orientation of the directivity, is set. More specifically, the microphone array 30 controls individually the amounts of delay to be provided, through delay processing, for the respective input signals from the microphone devices 32-1 through 32-8 to thereby orient the directivity to the direction corresponding to the angle indicated by the virtual sound source position setting command, and, then, temporarily terminate the responding-to-command task.

Figure 35:
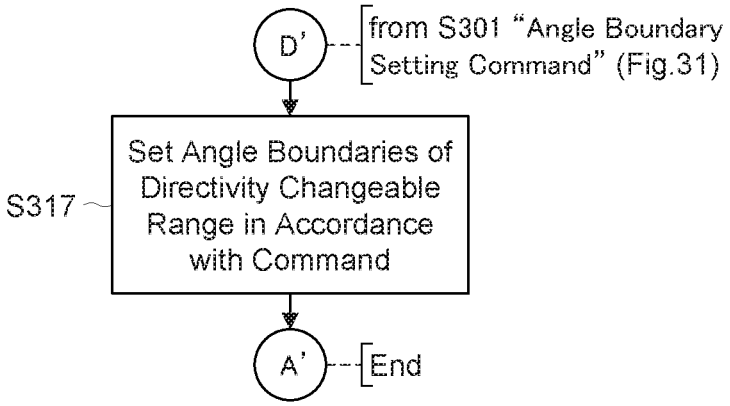
FIG. 35 is still other flow chart continuing from FIG. 31.

If it is judged in Step S301 in FIG. 31 that the angle boundary setting command (see Step S39 in FIG. 18) has been received, the microphone array 30 advances to Step S317 in FIG. 35, and sets the angle boundaries of the directivity changeable range in accordance with the angle boundary setting command. More specifically, the angle indicated by the angle boundary setting command is held as the above-described reference angle. Then, the responding-to-command task is temporarily terminated.

Figure 36:
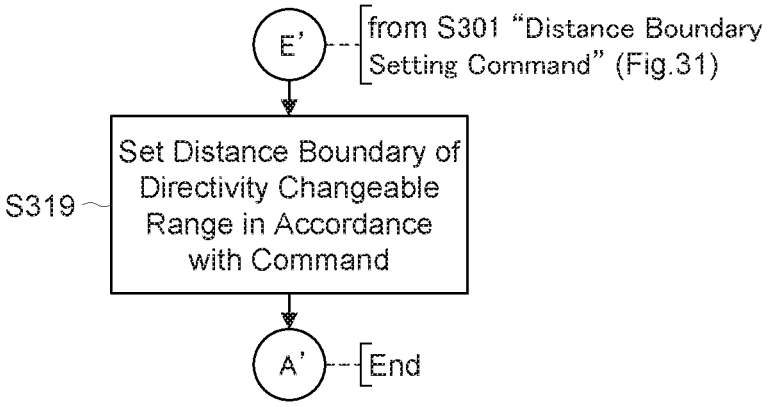
FIG. 36 is still other flow chart continuing from FIG. 31.

When it is determined in Step S301 in FIG. 31 that the distance boundary setting command (see Step S41 in FIG. 19) has been received, the microphone array 30 advances to Step S319 shown in FIG. 36. In Step S319, the microphone array 30 sets the distance boundary of the directivity changeable range in accordance with the distance boundary setting command. More specifically, the microphone array 30 holds the distance indicated by the distance boundary setting command as the aforementioned reference distance. After that, the microphone array 30 temporarily terminates the responding-to-command task.

Figure 37:
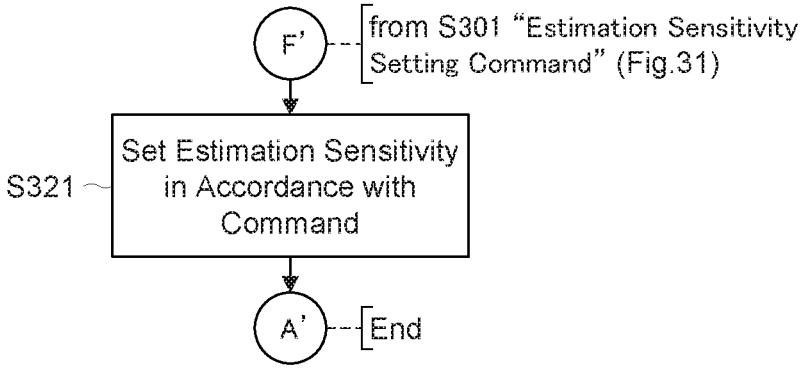
FIG. 37 is still other flow chart continuing from FIG. 31.

If it is determined in Step S301 in FIG. 31 that the estimation sensitivity setting command (see Step S41 in FIG. 19) has been received, the microphone array 30 advances to Step S321 in FIG. 37. In this Step S321, the microphone array 30 sets the estimation sensitivity of the sound source position estimating function in accordance with the estimation sensitivity setting command. More specifically, the sensitivity level in compliance with the estimation sensitivity setting command is held as the aforementioned reference level. After that, the microphone array 30 temporarily terminates the responding-to-command task.

Figure 38:
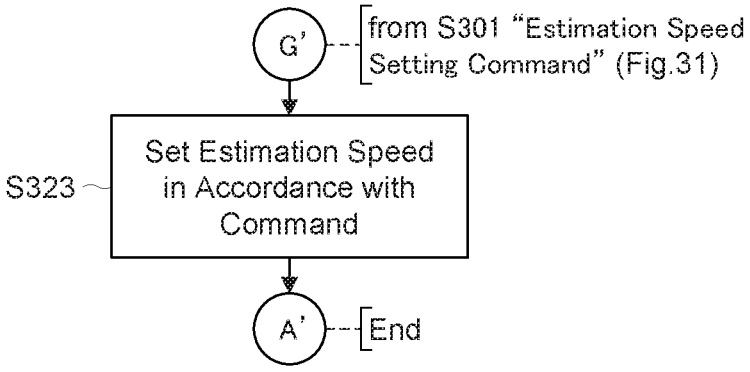
FIG. 38 is still other flow chart continuing from FIG. 31.

If it is determined in Step S301 of FIG. 31 that the estimation speed setting command (see Step S45 in FIG. 21) has been received, the microphone array 30 advances to Step S323 in FIG. 38. In Step S323, the microphone array 30 sets the estimation speed of the sound source position estimating function in accordance with the estimation speed setting command. More specifically, the microphone array 30 changes the aforementioned filter time constant, and, thereafter, temporarily terminates the responding-to-command task.

Figure 39:
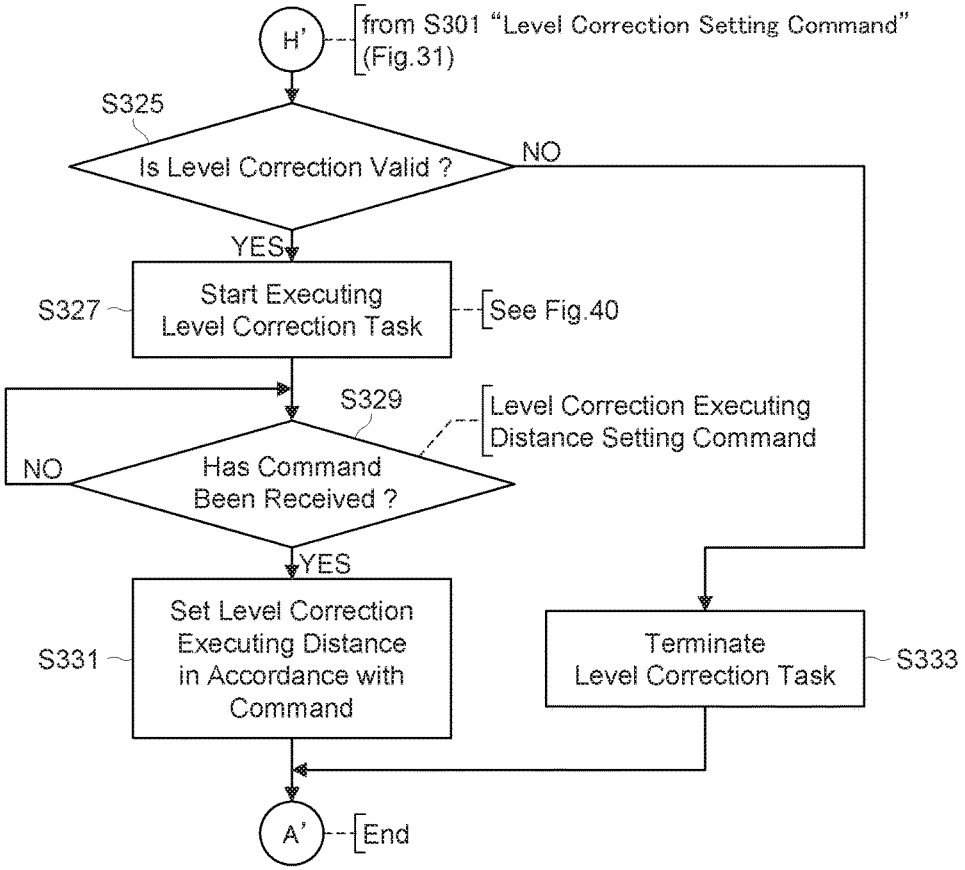
FIG. 39 is still other flow chart continuing from FIG. 31.

When it is determined in Step S301 in FIG. 31 that the level correction setting command (see Step S51 or Step S57 in FIG. 22) has been received, the microphone array 30 advances to Step S325 in FIG. 39. In Step S325, the microphone array 30 judges whether or not the level correction setting command is for turning on the level correction function. When the level correction setting command is for turning on the level correction function, the microphone array 30 advances to Step S327, where the microphone array 30 starts executing the later-mention level correction task. Then, the microphone array 30 advances to Step S329 and waits for the level correction executing distance setting command (see Step S53 in FIG. 22) from the control system 70. Upon receiving the level correction executing distance setting command in Step S329, the microphone array 30 advances to Step S331, where it sets, or holds in it, the level correction executing distance in accordance with the level correction executing distance setting command. Then, the microphone array 30 temporarily terminates the responding-to-command task. On the other hand, if it is determined in Step S325 that the level correction setting command is for turning off the level correction function, the microphone array 30 advances from Step S325 to Step S333, where it terminates the execution of the level correction task. Then, the microphone array 30 temporarily terminates the responding-to-command task.

Figure 40:
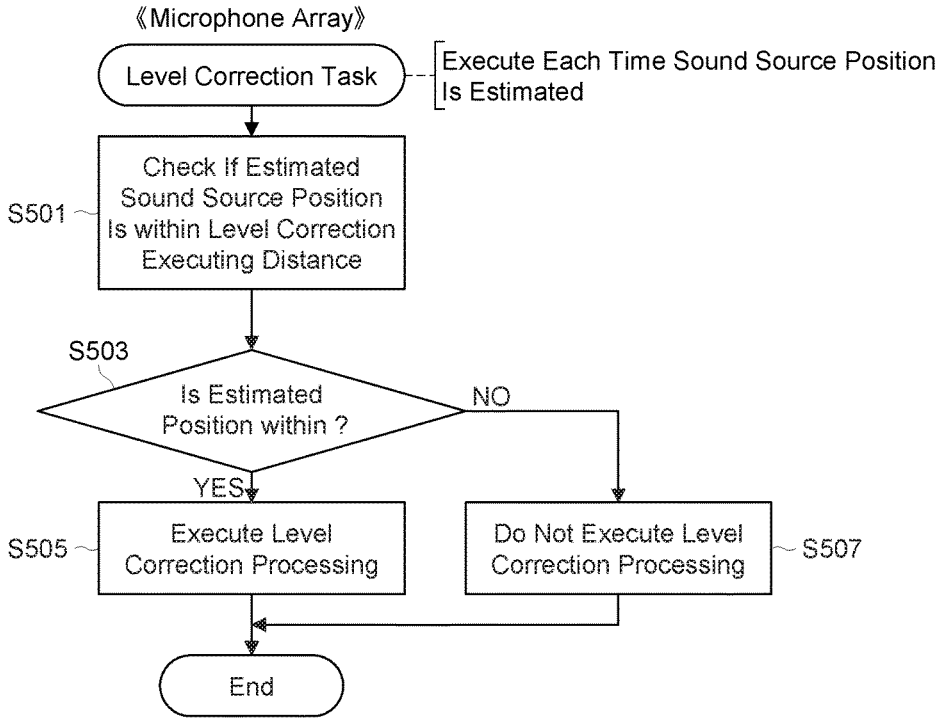
FIG. 40 is still other flow chart continuing from FIG. 31.

Now, referring to FIG. 40, the level correction task is described. The level correction task is executed each time the sound source position is estimated by the aforementioned sound source position estimating function. In the level correction task, the microphone array 30 first advances to Step S501, where it checks if the estimated sound source position is within the level correction executing distance. When the microphone array 30 judges in Step S503 that the sound source position is within the level correction executing distance, it advances to Step S505 and executes the level correction processing, i.e. the levels of the audio signals from the respective microphone devices 32-1 through 32-8 are restricted. After that, the microphone array 30 temporarily terminates the level correction task. On the other hand, if it is judged in Step S503 that the sound source position is beyond the level correction executing distance, the microphone array 30 advances to Step S507 and disables the level correction processing, and, then, temporarily terminates the level correction task.

Figure 41:
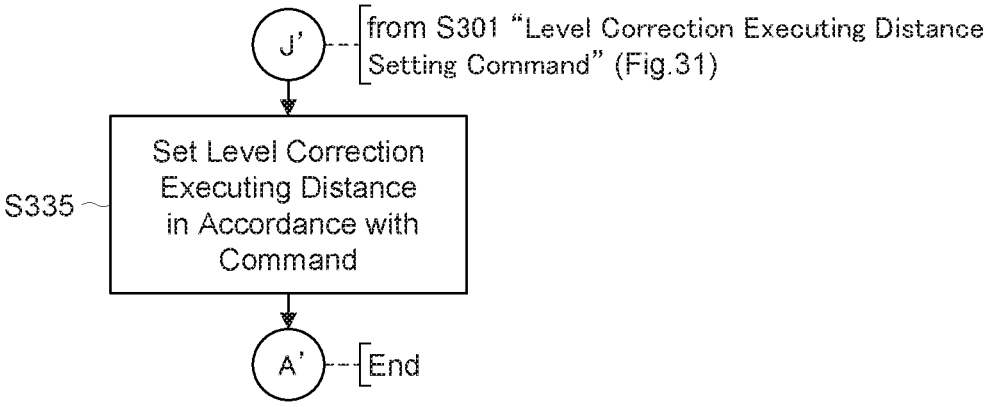
FIG. 41 is still other flow chart continuing from FIG. 31.

Returning to Step S301 in FIG. 31, if it is determined in Step S301 that the level correction executing distance setting command (see Step S59 in FIG. 23) has been received, the microphone array 30 advances to Step S335 in FIG. 41, where it sets the level correction executing distance in accordance with the level correction executing distance setting command, and, then, temporarily terminates the responding-to-command task.

Figure 42:
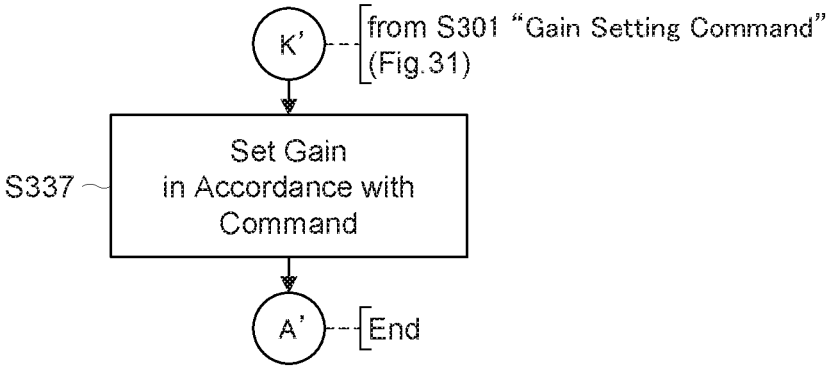
FIG. 42 is still other flow chart continuing from FIG. 31.

If it is determined in Step S301 that the gain setting command (see Step S73 in FIG. 28) has been received, the microphone array 30 advances to Step S337 in FIG. 42 and sets the gain in accordance with the gain setting command in Step S337. After that, the microphone array 30 temporarily terminates the responding-to-command task.

Figure 43:
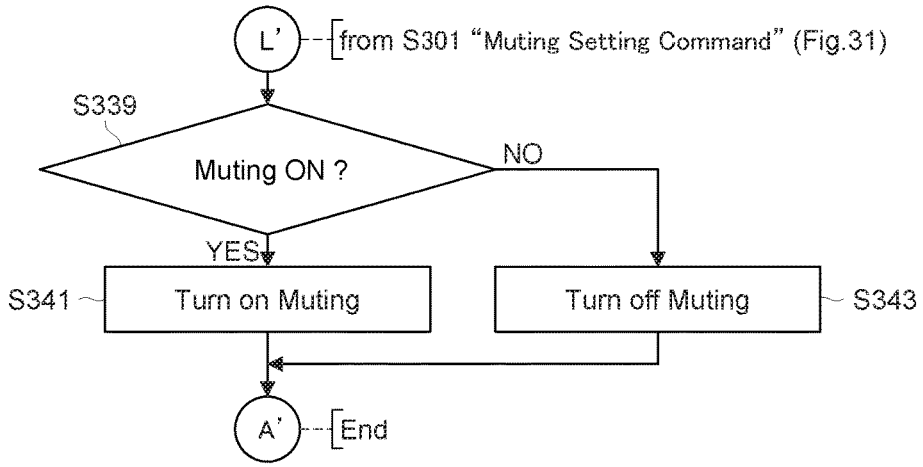
FIG. 43 is still other flow chart continuing from FIG. 31.

If it is determined in Step S301 in FIG. 31 that the muting setting command (see Step S79 or Step S83 in FIG. 29) has been received, the microphone array 30 advances to Step S339 in FIG. 43, in which it judges whether the muting setting command is for commanding the turning on of the muting function. If the muting setting command is to turn on the muting function, the microphone array 30 advances to Step S341. In Step S341, the microphone array 30 turns on the muting processing and, thereafter, temporarily terminates the responding-to-command task. If, on the other hand, it is judged that the muting setting command is to turn off the muting function, the microphone array 30 advances to Step S343, where it turns off the muting processing, and, then, temporarily terminates the responding-to-command task.

As described above, according to the described embodiment, it is possible to intuitively grasp, by means of the control system 70, the operating state of the microphone array 30 including the sound source position estimated by the microphone array 30. In addition, the control of the microphone array 30 by the control system 70 can be intuitively realized by so-called GUI. Accordingly, the microphone array can be utilized efficiently.

The description of the embodiment given above is just for explaining an example and does not limit the scope of the invention.

For example, the control system 70 is not limited to a tablet-type computer, but it may be a notebook-type computer or a desktop computer. In other words, the control system 70 can be such a computer provided with a display functioning as display means and a pointing device, functioning as input means, represented by a keyboard and a mouse, separately. Operable elements, such as buttons and markers, displayed on the display means are arranged to be operable through the input means. The control system 70 need not be limited to a universal computer, but may be a device for exclusive use.

The bidirectional communication between the microphone array 30 and the control system 70 has been described as being realized by wireless LAN, but it is not limited to it. Wireless communication techniques other than wireless LAN or wired communication techniques may be used to realize bidirectional communications between the microphone array 30 and the control system 70.

The simulation diagram 302 need not be a two-dimensional view diagram such as plan views, but three-dimensional ones, such as bird's eye view diagrams may be used instead.

Although, in the described embodiment, in order to indicate the volume of the sound source, the size of the volume mark 318 attached to the sound source mark 316 is made to vary with the change of the volume, other arrangements can be adopted. For example, the shape, color and/or pattern etc. of the volume mark 318 may be arranged to vary. In other cases, the shape, color and/or pattern etc. of the sound source mark 316 may be arranged to vary.

Although the present invention has been described as being embodied in the loudspeaker system 10 for use in lecturing, the present invention, needless to say, can be used for other purposes.

EXPLANATION OF REFERENCE NUMBERS

10: Loudspeaker System for Use in Lecturing
30: Microphone Array
50: Communication Unit
70: Control System
72: Processor
76: Display
78: Communication Circuitry

The invention claimed is:

1. A microphone array control system for controlling a microphone array including plural microphone devices, said microphone array having (i) a sound source position estimating function for estimating a position of a sound source based on audio signals outputted from said plural microphone devices and (ii) a sound collecting characteristic varying function for varying a sound collection characteristic thereof including a directivity thereof so as to make said sound collection characteristics suitable for detecting a sound emanating from said sound source, comprising:

a display;

an input; and a processor configured to:

cause a simulation diagram simulating a space in which said microphone array is disposed to be displayed on said display;

acquire, from said microphone array, predetermined microphone data including sound source position information representing the position of said sound source as estimated by said sound source position estimating function;

display, on said simulation diagram, a sound source symbol representing said sound source based on said sound source position information contained in said acquired microphone data;

set a range over which the sound collection characteristic varying function can vary the sound collection characteristics, through a user operation using the input; and cause a sound collection characteristic variable range symbol representing said set range, to be displayed on said simulation diagram.

2. The microphone array control system according to claim 1, wherein said setting of said range includes transmitting a command according to the user operation on a marker associated with the sound collection characteristic variable range symbol, to said microphone array.

3. A microphone array control system for controlling a microphone array including plural microphone devices, said microphone array having (i) a sound source position estimating function for estimating a position of a sound source based on audio signals outputted from said plural microphone devices and (ii) an audio signal restricting function for restricting said audio signals when the position of said sound source approaches said microphone array, comprising:

a display;

an input; and a processor configured to:

cause a simulation diagram simulating a space in which said microphone array is disposed to be displayed on said display;

acquire, from said microphone array, predetermined microphone data including sound source position information representing the position of said sound source as estimated by said sound source position estimating function;

display, on said simulation diagram, a sound source symbol representing said sound source based on said sound source position information contained in said acquired microphone data;

set a distance from said microphone array which is a boundary for determining whether or not said audio signals should be restricted, through a user operation using the input; and cause a restriction executing distance symbol representing said set distance, to be displayed on said simulation diagram.

4. The microphone array control system according to claim 3, wherein said setting of said distance includes transmitting a command according to the user operation on a marker associated with the restriction executing distance symbol, to said microphone array.

5. A non-transitory computer-readable storage medium storing instructions that, when executed by a computer, said computer including a display and an input and being adapted to be connected to a microphone array, said microphone array including plural microphone devices and having (i) a sound source position estimating function for estimating a position of a sound source based on audio signals outputted from said plural microphone devices and (ii) a sound collecting characteristic varying function for varying a sound collection characteristic thereof including a directivity thereof so as to make said sound collection characteristics suitable for detecting a sound emanating from said sound source, cause said computer to:

cause the display to display a simulation diagram simulating a space in which said microphone array is disposed;

acquire, from said microphone array, predetermined microphone data including sound source position information representing the position of said sound source as estimated through said sound source position estimating function;

cause a sound source symbol representing said sound source to be displayed on said simulation diagram based on said sound source position information in said acquired microphone data;

set a range over which the sound collection characteristic varying function can vary the sound collection characteristics, through a user operation using the input; and cause a sound collection characteristic variable range symbol representing said set range, to be displayed on said simulation diagram.

6. A non-transitory computer-readable storage medium storing instructions that, when executed by a computer, said computer including a display and an input and being adapted to be connected to a microphone array, said microphone array including plural microphone devices and having (i) a sound source position estimating function for estimating a position of a sound source based on audio signals outputted from said plural microphone devices and (ii) an audio signal restricting function for restricting said audio signals when the position of said sound source approaches said microphone array, cause said computer to:

cause the display to display a simulation diagram simulating a space in which said microphone array is disposed;

acquire, from said microphone array, predetermined microphone data including sound source position information representing the position of said sound source as estimated through said sound source position estimating function;

cause a sound source symbol representing said sound source to be displayed on said simulation diagram based on said sound source position information in said acquired microphone data;

set a distance from said microphone array which is a boundary for determining whether or not said audio signals should be restricted, through a user operation using the input; and cause a restriction executing distance symbol representing said set distance, to be displayed on said simulation diagram.

* * * * *